US006938892B2

(12) United States Patent
Abe et al.

(10) Patent No.: US 6,938,892 B2
(45) Date of Patent: Sep. 6, 2005

(54) PAPER IDENTIFICATION COUNTER AND PAPER IDENTIFICATION AND COUNTING METHOD

(75) Inventors: Hideo Abe, Tokyo (JP); Yoshikazu Takagi, Yokohama (JP); Hiroyuki Shimada, Kawasaki (JP); Makoto Shinkai, Yokohama (JP); Takahiro Ogawa, Kawasaki (JP)

(73) Assignee: Billcon Corporation, Tokyo (JP)

( * ) Notice: Subject to any disclaimer, the term of this patent is extended or adjusted under 35 U.S.C. 154(b) by 0 days.

(21) Appl. No.: 10/882,391

(22) Filed: Jul. 2, 2004

(65) Prior Publication Data

US 2005/0023106 A1 Feb. 3, 2005

Related U.S. Application Data

(62) Division of application No. 09/625,359, filed on Jul. 25, 2000, now Pat. No. 6,782,987.

(30) Foreign Application Priority Data

Jun. 2, 2000 (JP) ..... 2000-166679

(51) Int. Cl.[7] ..... B65H 3/06
(52) U.S. Cl. ..... 271/109; 271/119
(58) Field of Search ..... 271/3.08, 4.01, 271/4.08, 4.09, 10.01, 10.09, 10.11, 18, 114, 119, 120, 275; 74/112

(56) References Cited

U.S. PATENT DOCUMENTS

| | | | |
|---|---|---|---|
| 4,653,647 | A | 3/1987 | Hashimoto |
| 4,784,274 | A | 11/1988 | Mori et al. |
| 4,830,742 | A | 5/1989 | Takesako |
| 5,394,992 | A | 3/1995 | Winkler |
| 5,402,895 | A | 4/1995 | Mikkelsen et al. |
| 5,465,821 | A | 11/1995 | Akioka |
| 5,550,929 | A | 8/1996 | Bianco |
| 6,125,195 | A | 9/2000 | Ohya et al. |
| 6,256,407 | B1 | 7/2001 | Mennie et al. |
| 6,438,262 | B1 | 8/2002 | Bernardini et al. |

FOREIGN PATENT DOCUMENTS

| | | | | |
|---|---|---|---|---|
| EP | 0 334 309 | | 9/1989 | |
| EP | 0.393.589 | A1 * | 10/1990 | ..... B65H/3/52 |
| EP | 0 952 556 | | 10/1999 | |
| GB | 2.132.737 | A * | 7/1984 | ..... F16C/13/00 |
| WO | WO 01/41078 | | 6/2001 | |

OTHER PUBLICATIONS

U.S. Appl. No. 10/497,157, filed Jun. 7, 2004, Abe et al.
U.S. Appl. No. 10/882,391, filed Jul. 2, 2004, Abe et al.

* cited by examiner

*Primary Examiner*—Donald P. Walsh
*Assistant Examiner*—Mark J. Beauchaine
(74) *Attorney, Agent, or Firm*—Oblon, Spivak, McClelland, Maier & Neustadt, P.C.

(57) ABSTRACT

A paper identification counter comprises a counter body, a hopper which is formed to the counter body and to which papers to be identified and counted are fed, a paper conveyance unit including a conveyance passage along which the papers such as currency notes from the hopper is conveyed one by one in a direction of a short width side of the papers, a paper identification unit disposed on a way of the conveyance passage for identifying and counting the papers; and a stacker in which the papers delivered from the conveyance passage are stacked. The conveyance passage includes a U-shaped curvilinear conveyance region on a way between the hopper and the stacker.

13 Claims, 23 Drawing Sheets

PAPER IDENTIFICATION COUNTER AND PAPER IDENTIFICATION AND COUNTING METHOD

CROSS-REFERENCE TO RELATED APPLICATIONS

This application is a divisional of U.S. patent application Ser. No. 09/625,359, filed Jul. 25, 2000, now U.S. Pat. No. 6,782,987, the entire contents of which are hereby incorporated herein by reference.

BACKGROUND OF THE INVENTION

The present invention relates generally to a paper identification counter for identifying and counting papers and to a paper identification counting method, and, more particularly, relates to a desktop type currency note identification counter and paper identification and counting method, capable of performing currency note denomination judgment or discrimination and counting processing at a high speed.

Such a paper identification counter has a form of, for example, a desktop type currency note identification counter for performing discrimination or judgement of currency note denomination or counting processing.

The conventional desktop type currency note identification counter has a hopper which is disposed at a top portion of a counter body on a front side thereof and into which are fed and stacked currency notes to be identified. When this identification counter is operated, a stack of currency notes stored in the hopper are delivered one by one by a delivery roller. The thus delivered currency notes are transported one by one along a conveyance passage within the counter body in the short-side (width) direction of currency notes. An identification unit is disposed on the way of the conveyance passage to effect the currency note denomination judgment (discrimination) or true-counterfeit judgment (discrimination) processing, to thereby count the number of currency notes or the sum thereof.

After the denomination discrimination and counting by the identification unit, the currency notes are directed through the downstream conveyance passage to a stacker, from which the currency notes are retrieved.

The conventional currency note identification counter is arranged such that the currency notes delivered from the hopper are reversed largely by the delivery roller, after which they are led to the stacker through a substantially rectilinear conveyance passage. In this case, the identification unit is disposed on the way of the rectilinear conveyance passage (U.S. Pat. Nos. 5,912,982 and 5,692,067).

Due to the substantially rectilinear configuration of the note conveyance passage, it would be difficult for the conventional currency note identification counter to secure a sufficient conveyance passage length. In the event that the currency note identification counter is of a small-sized, compact desktop type in particular, it is inevitable, because of its short conveyance passage length, to perform the currency note identification and counting processing at a low speed of the order of 700 to 800 sheets per minute, making the high-speed processing difficult.

In the currency note identification counter, any counterfeit bills or damaged notes need to be excluded or rejected from objects to be identified and counted. For this purpose, it is necessary after the identification of the currency notes by the identification unit to operate a reject mechanism while making a check of the passage timing of the currency notes to be rejected, which will necessitate a conveyance passage length corresponding to the time between the start of the check and the start of the operation. A predetermined time will also be needed for the processing of identification signals from the identification unit or for the operation of the reject mechanism. A further speedup will need a greater distance through which the currency notes must be conveyed along the conveyance passage within a predetermined time.

In the case of the small-sized desktop currency note identification counter, it would not be practical to enhance the currency note counting processing speed due to the difficulty to secure the sufficient length of the downstream conveyance passage of the identification unit. For this reason, the identification counter could process only 700 to 800 notes per minute, or at most about 1,000 notes per minute.

The currency notes, typical papers, may include various notes such as notes liable to fold or notes with folded corners. In the event that the currency notes in various conditions are brought into the conveyance passage, they may possibly jam on the way of the conveyance passage. For this reason, the currency note identification counter has to prevent the occurrence of any jamming or take any measures against the possible jamming, such as rapidly stopping the feed of the currency notes to simply reject the jammed notes.

However, the conventional currency note identification counter allows for by no means the sufficient measures against the jamming, and, once the currency notes jam on the way of the conveyance passage, makes it difficult to simply remove the jammed notes.

Furthermore, the identification of the currency notes by the identification unit is merely effected by partially sensing the features of the currency notes, with the result that only the currency notes of a specific country can be identified. It would thus be difficult to enhance the currency note identification abilities and to impart the versatility to the identification unit. For this reason, the conventional currency note identification counter can handle only the currency notes of a specific country. If it is desired to identify and count the currency notes of the other countries, then additional identification units for identifying the features of the currency notes of the other countries must separately be prepared to replace one identification unit with another depending upon circumstances.

SUMMARY OF THE INVENTION

The present invention was conceived in view of the above circumstances.

It is therefore an object of the present invention to provide a small-sized, compact desktop type paper identification counter and its identification and counting method, ensuring rapid identification and counting processing of papers such as currency notes.

Another object of the present invention is to provide a small-sized, compact desktop type paper identification counter and its identification and counting method, capable of effectively utilizing an interior space of a counter body, securing a sufficient conveyance passage length, and performing high-speed identification and counting processing.

Further object of the present invention is to provide a paper identification counter having a counter body whose front portion is provided with one stacker and one pocket and also provide its identification and counting method capable of discharging out-of-identification/counting papers rejected on the way of the conveyance passage into the pocket for storing the same.

A still further object of the present invention is to provide a paper identification counter and its identification and counting method, capable of effecting identification and counting processing at a conveyance speed of 1,200 sheets per minute or more and ensuring simple and easy opening of the conveyance passage upon occurrence of the paper jamming.

A still further object of the present invention is to provide a paper identification counter ensuring simple and easy retrieval and reject of the jammed papers upon the occurrence of paper jamming on the way of the conveyance passage.

A still further object of the present invention is to provide a paper identification counter capable of ensuring an easy retrieval of papers being stacked within the stacker or the pocket.

A still further object of the present invention is to provide a paper identification counter having a control CPU and an arithmetic CPU mounted on a circuit board to relieve the processing load imposed on the control CPU to thereby achieve an enhanced identification and counting processing speed.

A still further object of the present invention is to provide a paper identification counter having an autonomous rotation control circuit to provide an automatic control of motor rotational speeds of a delivery drive motor and a conveyance drive motor, thereby relieving the burden processing to be effected by the control CPU.

A still further object of the present invention is to provide a paper identification counter by using a bus emulator circuit to perform a drive operation of the general-purpose display panel such as an LCD through the control CPU, to thereby relieve the burden processing to be effected by the control CPU, allowing for the speedup of the processing.

The above and other objects can be achieved according to the present invention by providing, in one aspect, a paper identification counter comprising:

a counter body;

a hopper which is formed to the counter body and to which papers to be identified and counted are fed;

a paper conveyance unit including a conveyance passage along which the papers from the hopper is conveyed one by one in a direction of a short width side of the papers;

a paper identification unit disposed on a way of the conveyance passage for identifying and counting the papers; and a stacker in which the papers delivered from the conveyance passage are stacked;

the conveyance passage including a U-shaped curvilinear conveyance region on a way between the hopper and the stacker.

In a preferred embodiment of this aspect, the hopper is disposed at a top portion of the counter body and the stacker is disposed on a front surface portion of the counter body at the lower portion thereof in an installed state of the counter, the U-shaped curvilinear conveyance region is formed on a back side portion of the counter body at a lower portion thereof, and the conveyance passage includes, in combination, a rectilinear conveyance identification region extending from the hopper to the U-shaped curvilinear conveyance region and a downstream conveyance region extending from the U-shaped curvilinear conveyance region to the stacker.

The U-shaped curvilinear conveyance region provides a paper identification/judgement region and the downstream conveyance region provides a paper reject discrimination conveyance region. The paper identification unit is disposed in the rectilinear conveyance region of the conveyance passage, the paper identification unit including at least a kind identification sensor for identifying and discriminating the kind of the papers and a true-counterfeit identification unit for judging whether the papers are true or counterfeit, the kind identification sensor and the true-counterfeit identification unit being spaced apart from each other with an interval in the longitudinal direction of the conveyance passage.

The U-shaped curvilinear conveyance region comprises a reverse feed drive roller having a diameter of two-thirds or more of the paper feed width, a curved guide plate confronting an outer periphery of the reverse feed drive roller, and a pair of driven rollers disposed on an inflow side and an outflow side of the curvilinear conveyance region. The downstream conveyance region is angled and forms the reject discrimination conveyance region for rejecting the papers out of identification and damaged papers and a reject conveyance region diverges from the downstream of the reject discrimination conveyance region.

The downstream conveyance region, a gate timing sensor is disposed at an inlet side of the reject discrimination conveyance region for detecting presence or absence of the papers being conveyed, the downstream conveyance region including a switching gate disposed at a downstream side of the timing sensor to allow a changeover operation to a reject conveyance region in response to a detection signal from the gate timing sensor.

In another aspect of the present invention, there is provided a paper identification counter comprising:

a counter body;

a hopper which is formed to the counter body and to which papers to be identified and counted are fed;

a delivery mechanism for delivering the papers fed to he hopper to a conveyance passage;

a paper conveyance unit for conveying the delivered papers one by one along said conveyance passage in a direction of short width side of the papers at a conveyance speed of 1,200 sheets or more per minute;

a paper identification unit disposed on a way of the conveyance passage for identifying and counting the papers; and a stacker in which the identified and counted papers delivered through a U-shaped curved region are stacked;

the paper conveyance unit including a paper delivery drive system for delivering and conveying the papers from the hopper up to the U-shaped curved region and a paper conveyance drive system for conveying the papers from the U-shaped curved region up to the stacker, the paper delivery drive system and the paper conveyance drive system being driven by driving sources, respectively.

In a preferred embodiment of this aspect, the paper conveyance drive system conveys, to a pocket, the papers lying within a reject conveyance region diverging from the U-shaped curved region at a downstream side thereof.

In a further aspect of the present invention, there is provided a paper identification counter comprising:

a counter body;

a hopper disposed at a top portion of the counter body;

a stacker disposed at a front portion of the counter body;

a conveyance passage formed in the counter body so as to extend from the hopper to the stacker; and a pocket disposed above the stacker and adapted to store therein papers rejected from the conveyance passage, said pocket including a pocket bearer and a support member covering the pocket bearer from a front side thereof.

In a preferred embodiment of this aspect, the pocket includes a pocket bearer disposed at a free end of a guide arm of a reject conveyance passage opening mechanism, a forward extending pocket arm securely fastened to the counter body and a support member interposed between the free end of the pocket arm and the fore-end of the pocket bearer, the support member being supported by one of the free end of the pocket arm and the fore-end of the pocket bearer and being releasably fixed to another one thereof.

The pocket is opened at both sides thereof, a front side portion of the pocket being covered with a pair of side members which are supported by one of the free end of the pocket arm and the fore-end of the pocket bearer, the pair of side members being releasably fixed to another one thereof by one-touch fastening means such as magnet means.

The support member is provided with a shock absorbing resilient member such as sponge adhering to an inside portion of the pocket and the support bearer is notched centrally at the front portion thereof so as to form a retrieval opening.

In a still further aspect of the present invention, there is provided a paper identification counter comprising:

a counter body;

a hopper disposed at a top portion of the counter body;

a stacker disposed at a front portion of the counter body;

a conveyance passage formed in the counter body so as to extend from the hopper to the stacker, the conveyance passage including a rectilinear conveyance passage descending from the hopper through a delivery mechanism along a back side of the counter body, a U-shaped curvilinear conveyance passage continuous with the rectilinear conveyance passage, disposed at the lower portion on the back side of the counter body, and a downstream conveyance passage extending from the curvilinear conveyance passage to the stacker; and a back side conveyance passage opening mechanism disposed on a back side of the rectilinear conveyance passage so as to be pivotal about a pivot at a lower portion of the-counter body in an installed state thereof.

In a preferred embodiment of this aspect, the back side conveyance opening mechanism includes a rear opening guide arm mechanism which is pivotal about a pivot disposed at a lower front portion of said U-shaped curvilinear conveyance passage, the opening guide arm mechanism including guide plates constituting the rectilinear conveyance passage and the U-shaped curvilinear conveyance passage. The rear opening guide arm mechanism includes a two-foldable frame structure comprising a lower guide arm, an upper guide arm and lock means for fixing through one-touch operation a top portion of the upper guide arm to a back side upper portion of:the counter body to be detachably.

In a still further aspect of the present invention, there is provided a paper identification counter comprising:

a counter body;

a hopper disposed at a top portion of the counter body;

a stacker disposed at a front portion of the counter body;

a conveyance passage formed in the counter body so as to extend from the hopper to the stacker, the conveyance passage including a rectilinear conveyance passage descending from the hopper through a delivery mechanism along a back side of the counter body, a U-shaped curvilinear conveyance passage continuous with the rectilinear conveyance passage, disposed at a lower portion on the back side of the counter body, and an angled conveyance passage extending from the curvilinear conveyance passage to the stacker; and an angled conveyance passage opening mechanism disposed below the angled conveyance passage to be pivotal about a pivot at a lower portion of the counter body in an installed state thereof.

In a preferred embodiment of this aspect, the angled conveyance passage opening mechanism includes a front opening guide arm mechanism to be pivotal about a pivot disposed at a lower front portion of the U-shaped curvilinear conveyance passage, the opening guide arm mechanism including a guide plate constituting the angled conveyance passage. The front opening guide arm is displaced between a set position and an opening position around a pivot common to the rear opening guide arm mechanism, the front opening guide arm mechanism being always biased towards the set position.

In a still further aspect of the present invention, there is provided a paper identification counter comprising:

a counter body;

a hopper disposed at a top portion of the counter body;

a stacker disposed at a front portion of the counter body;

a conveyance passage formed in said counter body so as to extend from the hopper to the stacker, the conveyance passage including a rectilinear conveyance passage descending from the hopper through a delivery mechanism along a back side of the counter body, a U-shaped curvilinear conveyance passage continuous with the rectilinear conveyance passage, disposed at the lower portion on the back side of the counter body, an angled conveyance passage extending from the curvilinear conveyance passage to the stacker, and a reject conveyance passage diverging from the angled conveyance passage at a top portion thereof; and a reject conveyance passage opening mechanism disposed below the reject conveyance passage to open the reject conveyance passage.

In a preferred embodiment of this aspect, the reject conveyance passage opening mechanism includes an opening guide arm mechanism to be pivotal about a pivot disposed centrally at a lower portion of the counter body, the opening guide arm mechanism including a guide plate constituting the reject conveyance passage. The opening guide arm mechanism is releasably attached, at a free end side thereof, to the counter body by locking means, the locking means being released through an operative force transmission mechanism to thereby open the opening guide arm mechanism by its own weight. The opening guide arm mechanism includes a guide arm which is pivotable about a pivot, the guide arm being formed at a free end thereof with a pocket bearer for a pocket.

In a still further aspect of the present invention, there is also provided a paper identification counter comprising:

a counter body;

a hopper disposed at a top portion of the counter body;

a stacker disposed at a front portion of the counter body;

a conveyance passage formed in the counter body so as to extend from the hopper to the stacker, the conveyance passage including a rectilinear conveyance passage descending from the hopper through a delivery mechanism along a back side of the counter body, a U-shaped curvilinear conveyance passage continuous with the rectilinear conveyance passage, disposed at the lower portion on the back side of the counter body, and a downstream conveyance passage extending from the curvilinear conveyance passage to the stacker; and a paper identification unit disposed along the rectilinear conveyance passage and adapted to perform a paper identification/counting and true-counterfeit discrimination, the paper identification unit having a line sensor arranged so as to traverse said conveyance passage.

In a preferred embodiment of this aspect, the line sensor is a light transmission sensor comprising a light emission side sensor member and a light reception side sensor member which are splittable in assembly, the line sensor iterating a line scanning to scan the overall surfaces of papers conveyed along the conveyance passage for identification. The line sensor has a sensor body including a light emission side sensor member and a light reception side sensor member which are splittable in assembly, the line sensor being formed with a guide passage for guiding papers at a portion defined between the two sensor members. The guide passage includes a tapered guide path having a dimension gradually reduced towards an inlet side thereof and a parallel slit-like guide path that follows the tapered guide path, the slit-like guide path having a gap of several millimeters therein.

The light emission side sensor member of the line sensor includes a plurality of light emission elements arrayed in line, the light reception side sensor member of the line sensor including a plurality of light reception elements arrayed in a line so as to correspondingly confront the light emission elements.

The light emission side sensor member of the line sensor includes a plurality of light emission elements arrayed in a line at a predetermined pitch and a lens member for collimating diffused rays from the plurality of light emission elements, the light reception side sensor member of the line sensor including a plurality of light reception elements correspondingly confronting the plurality of light emission elements and a lens member for focusing parallel rays from the plurality of light emission elements to the plurality of light reception elements.

The light emission side sensor member of the line sensor includes several tens of light emission elements arrayed at 5 mm pitch and includes several tens of light reception elements correspondingly confronting the light emission elements.

The paper identification unit comprises a couple of light reflection front-reverse identification sensors disposed on both sides of the conveyance passage for discriminating front or reverse of the papers, the couple of identification sensors being spaced apart from each other in a width direction of the conveyance passage. The paper identification unit comprises a true-counterfeit identification sensor for judging the true or counterfeit of papers, the true-counterfeit identification sensor being composed of at least one of a magnet sensor and an UV sensor.

In a still further aspect of the present invention, there is also provided a paper identification counter comprising:

a counter body;

a hopper disposed at a top portion of the counter body;

a stacker disposed at a front portion of the counter body;

a conveyance passage formed in the counter body so as to extend from the hopper to the stacker;

a feed mechanism for feeding papers stacked on a bottom of said hopper to the conveyance passage; and a delivery mechanism for delivering the papers from the feed mechanism to the conveyance passage;

the feed mechanism and the delivery mechanism having a feed roller and a delivery roller, respectively, which are rotationally driven in synchronism with each other, the feed roller and the delivery roller each being formed, at a portion in a circumferential direction thereof, a friction member for providing a paper feed frictional force, the feed roller and the delivery roller being each provided with a balancer weight at a location diametrically opposing to the friction members.

In a preferred embodiment of this aspect, the delivery mechanism includes a stop member coming into press contact with the delivery roller, the stop member preventing papers from being fed in an overlapped manner.

In a still further aspect of the present invention, there is also provided a paper identification counter comprising:

a counter body;

a hopper disposed at a top portion of the counter body;

a stacker disposed at a front portion of the counter body;

a conveyance passage formed in the counter body so as to extend from the hopper to the stacker, the conveyance passage comprising a rectilinear conveyance passage descending from the hopper through a delivery mechanism along a back side of the counter body, the rectilinear conveyance passage including a paper identification unit provided with a line sensor, the line sensor being a light transmission detector including a plurality of light emission elements which are arrayed in a width direction of the conveyance passage and including a plurality of light reception elements which confront the plurality of light emission elements in a one-to-one corresponding manner;

a scanning processing circuit arranged so as to serially scan, in a line, a train of the light reception elements of the line sensor; and an arithmetic CPU arranged so as to process serial scanning data from the scanning processing circuits.

In this aspect, the scanning processing circuit may comprise:

a sensor scanning circuit for serially scanning the train of the light reception elements of the line sensor in response to a drive signal from the control CPU and to an encoder drive signal from an encoder detecting a rotational speed of a delivery roller of a delivery mechanism;

a signal processing circuit for processing test data signals as a result of serial scanning of the train of the light reception elements; and an AD converter for converting an analog signal to a digital signal so as to input a test data digital signal from the AD converter to the arithmetic CPU.

In a preferred embodiment of the above aspect, the control CPU and the arithmetic CPU are mounted on a circuit board accommodated in a side space inside the counter body, the control CPU performing a control of a delivery drive motor, a conveyance drive motor, a brake for stopping said delivery drive motor and various sensors, the arithmetic CPU being an arithmetic only processor processing a scanning data from the line sensor.

The control CPU issues start/stop and brake signals for a delivery drive motor and a conveyance drive motor to a motor driver, the control CPU providing a rotation control of the drive motors by way of an autonomous rotation control circuit which receives a reference clock signal from the control CPU and a signal from an encoder detecting the rotational speed of the delivery drive motor and the conveyance drive motor. The control CPU includes a bus emulator circuit intervening between the control CPU and a display panel such as an LCD, the bus emulator circuit achieving matching with an interface of the display panel to partially share a processing to be effected by the control CPU.

The objects of the present invention can also be achieved in a still further aspect, by providing a method of identifying and counting papers comprising the steps of:

delivering papers stacked in a hopper to a conveyance passage at a delivery speed of 200 sheets per minute or more by means of a delivery mechanism;

guiding the delivered papers to a rectilinear conveyance passage descending along a back side of a counter body;

making paper identification, counting and true-counterfeit judgment by a paper identification unit in a process of passing the rectilinear conveyance passage;

leading the papers identified and counted by the paper identification unit, through a U-shaped curvilinear conveyance passage at a lower portion on a back side of the counter body, to a downstream conveyance passage; and delivering the papers through the downstream conveyance passage to a stacker for stacking the papers.

In a preferred embodiment of this aspect, the downstream conveyance passage is an angled conveyance passage having a top from which a reject conveyance passage diverges, and out-of-identification/counting papers, among said papers identified and counted by the paper identification unit, are led to the reject conveyance passage and then to a pocket for stacking the out-of-identification/counting papers.

The paper identifying unit includes a light transmission type line sensor, a train of light reception elements arrayed in the width direction of the conveyance passage are serially scanned by the line sensor to effect a line scanning to the papers in a longitudinal direction thereof, and the line scanning to scan the overall surfaces of the papers is iterated for identification and counting thereof.

In the paper identification counter and the paper identification counting method according to the present invention mentioned above, any space formed in the counter body is utilized effectively and positively as the conveyance passage to ensure a sufficient length of the conveyance passage and to achieve a size reduction and compactness of the paper identification counter, while simultaneously the papers can be identified and counted at a high speed in spite of the small-size and compactness of the paper identification counter.

Furthermore, in the paper identification counter and the paper identification counting method of the present invention, within the counter body, there are arranged the rectilinear conveyance passage extending along the back side of counter body, the U-shaped curved conveyance passage continuous with the rectilinear conveyance passage and positioned at the lower portion on the back side of the counter body, and the downstream conveyance passage extending from the curved conveyance passage up to the stacker, whereby a sufficient conveyance passage length is assured within the counter body so that the papers can be identified and counted at a high speed.

In the present invention, there is arranged such that the reject conveyance passage diverges from the downstream conveyance passage region and leads to the pocket, and due to the provision of one stacker and one pocket, currency notes out of identification and counting can be directed into the pocket for separate collection.

The paper identification counter in accordance with the present invention is arranged such that it is provided with the paper identification unit disposed on the rectilinear conveyance passage so as not to impede the conveyance of the papers, that the radius of curvature of the U-shaped curved conveyance passage is increased to effectively and efficiently prevent the paper jamming, and that it is provided with the back side conveyance passage opening mechanism, the angled conveyance passage opening mechanism and the reject conveyance passage opening mechanism so as to allow the rectilinear conveyance passage, U-shaped curved conveyance passage, the downstream angled conveyance passage and the reject conveyance passage to be opened to a large extent, whereby the jammed papers or the residing papers can simply and readily be retrieved and removed.

The paper identification counter in accordance with the present invention is arranged such that the light transmission type line sensor constituting the paper identification unit is provided in the rectilinear conveyance passage so as to traverse the conveyance passage, that a train of light reception elements of the line sensor are serially scanned by the scanning processing circuit, and that this serial scanning is iterated so that prompt and high accuracy scanning is effected over the entire surface of the papers, thereby making it possible to perform with high accuracy and promptly the identification and counting of the papers, and thus the judgment of denominations and counting of the currency notes, as well as the normal-damaged judgment and folded note detection.

At that time, the check data from the line sensor are allocated to the arithmetic CPU provided separately from the control CPU so that the arithmetic dedicated CPU can compute the check data to achieve high-speed processing and to relieve the burden of the control CPU, thereby providing for the speedup of the paper identification counting processing.

Still furthermore, in the paper identification counter of the present invention, the control CPU and the arithmetic CPU are mounted on the circuit board, so that the processing load of the control CPU is relieved with the enhanced identification and counting processing speed, and simultaneously, due to the provision of the autonomous rotation control circuit for providing the rotational speed control of the delivery drive motor and the conveyance drive motor, the motor rotational speeds of the delivery drive motor and the conveyance drive motor are automatically controlled by the autonomous rotation control circuit so that the processing executed by the control CPU is further relieved to achieve a further speedup of the paper identification processing.

The paper identification counter of the present invention is provided with the bus emulator circuit acting as an interface circuit between the control CPU and the display panel such as an LCD, so that the bus emulator circuit allows use of a general-purpose product as the display panel, whereby it is possible, upon the drive operation of the general-purpose display panel such as the LCD, to relieve the load processing of the control CPU, allowing the high-speed processing.

In the paper identification counter in accordance with the present invention, synchronous rotations are imparted to the feed drive roller and the delivery drive roller of the feed mechanism and the delivery mechanism, respectively, while simultaneously assuring a rotational balance due to the provision of the balancer weight diametrically opposite to the friction members disposed partially circumferentially of the feed drive roller and the delivery drive roller, thereby suppressing the occurrence of rattling or vibrations irrespective of the high-speed rotations of the feed drive roller and the delivery roller to ensure a stable and smooth rotational driving.

Still furthermore, the paper identification counter of the present invention is characterized by the open type pocket comprising the pocket arm by which the pocket is securely fastened to the counter body, the pocket bearer disposed at the free end of the guide arm of the reject conveyance passage opening mechanism, and the support member interposed between the free end of the pocket arm and the forefront end of the pocket bearer, with the support member being supported by one of the free end of the pocket arm and the fore-end of the pocket bearer, with the support member being fixed releasably with one touch to the other, thereby enabling the papers accommodated in the open type pocket to simply and readily be retrieved.

The nature and further characteristic features can be made more clear from the following descriptions made with reference to the accompanying drawings.

DESCRIPTION OF THE PREFERRED EMBODIMENTS

One embodiment of the present invention will be described hereunder with reference to the accompanying drawings.

Figure 1:
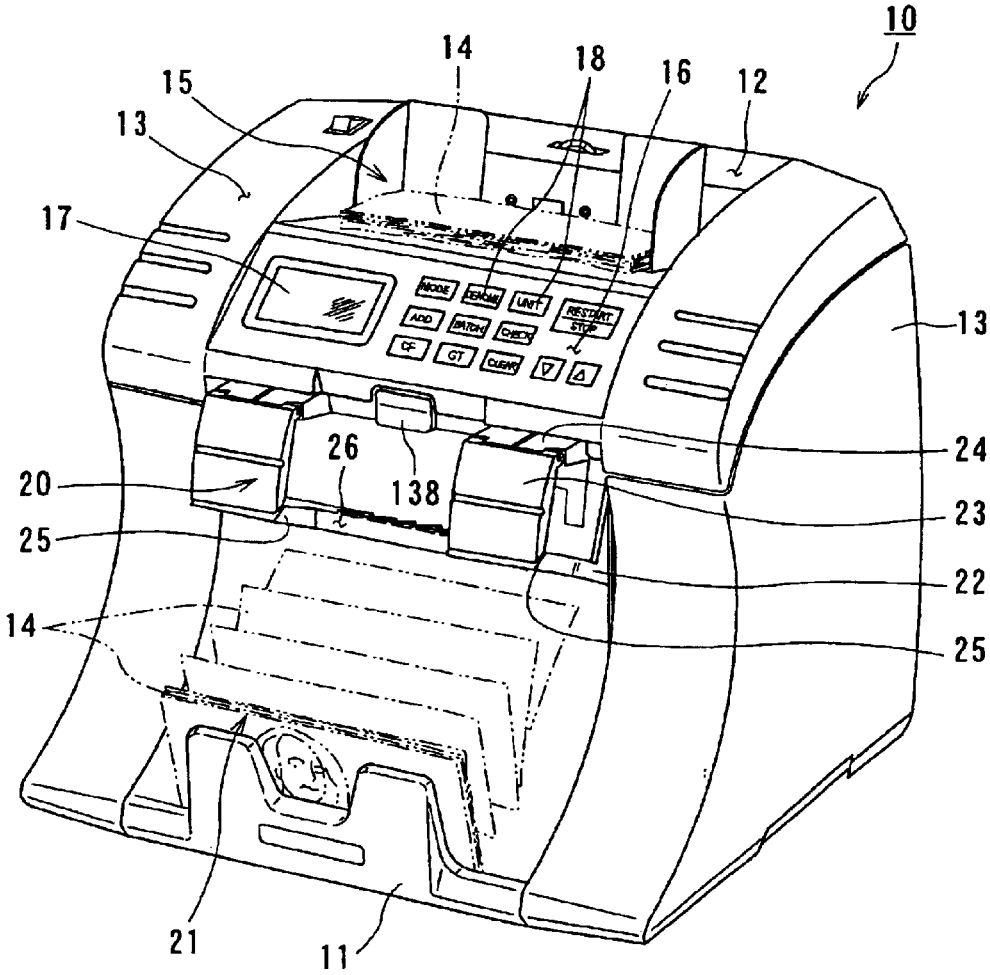
FIG. 1 is a perspective view showing one embodiment of a paper identification counter in the form of a currency note identification counter according to the present invention.

FIG. 1 is a general perspective view showing an example of a paper identification counter according to the present invention. The paper identification counter is a desktop type currency note identification counter for identifying and counting papers in the form of, e.g., currency notes at a high-speed of 1200 or more sheets per minute.

A currency note identification counter 10 is generally in the shape of a deformed or modified box and comprises a counter body 11 having top and sides covered with a top cover 12 and side covers 13, respectively, which are both made of resin. The top cover 12 is shaped into an arcuate curved surface that tilts smoothly downward from the back side, with the side covers 13 being continuous with the front end of the top cover 12. The front edges of the side covers 13 are fashioned into an arcuately concave smooth curved surface so that the currency note identification counter 10 can have S-shaped contour extending from the top toward the front surface.

The currency note identification counter 10 has at its top front side a hopper 15 for feeding currency notes 14 to be counted as sheets. The counter 10 further has at its top cover 12 a console panel 16 thereof and a display panel 17 in the form of LCDs allowing a full-graphic representation to provide a currency note identification/counting conditions, the console panel 16 and the display panel 17 being integrally formed therewith. The console panel 16 has a plurality of, e.g., twelve operation buttons or operation keys 18 arrayed thereon so that identification and counting can be effected depending on the various counter modes through the operations thereof.

The front side of the currency note identification counter 10 is provided at its upper portion with a pocket 20 in which is stored sheets such as currency notes discharged after the identification and counting, and at its lower portion with a stacker 21 in which is stored a stack of currency notes that have been identified and counted.

The pocket 20 protrudes forward from the front surface of the currency note identification counter 10 and is of a simple open type ensuring an easy retrieval of the sheets stacked. The pocket 20 is supported by a plate-like pocket bearer 22 for stacking the sheets and by a support member 23 for removably supporting the pocket bearer 22 at the extremity thereof. A resilient member 23*a* is adhered to the support member 23 at the inside thereof for preventing noise or injuries of the sheets. The support member 23 is pivotally supported at a free end of a cantilever pocket arm 24 which protrudes from the counter body 11 so that the cantilever pocket arm 24 can be mounted at a single operation on the front end of the pocket bearer. 22 from the lower end of the support member 23 by fixing means 25 such as magnets. The pocket bearer 22 is, at its center, notched to be opened forward so that the notched opening 26 and the release of the support member 23 ensure easy retrieval of the sheets stacked in the pocket 20. The support member 23 may be supported at the front end of the pocket bearer 22 so that the upper end of the support member 23 can removably be attached to the pocket art 24.

Figure 2:
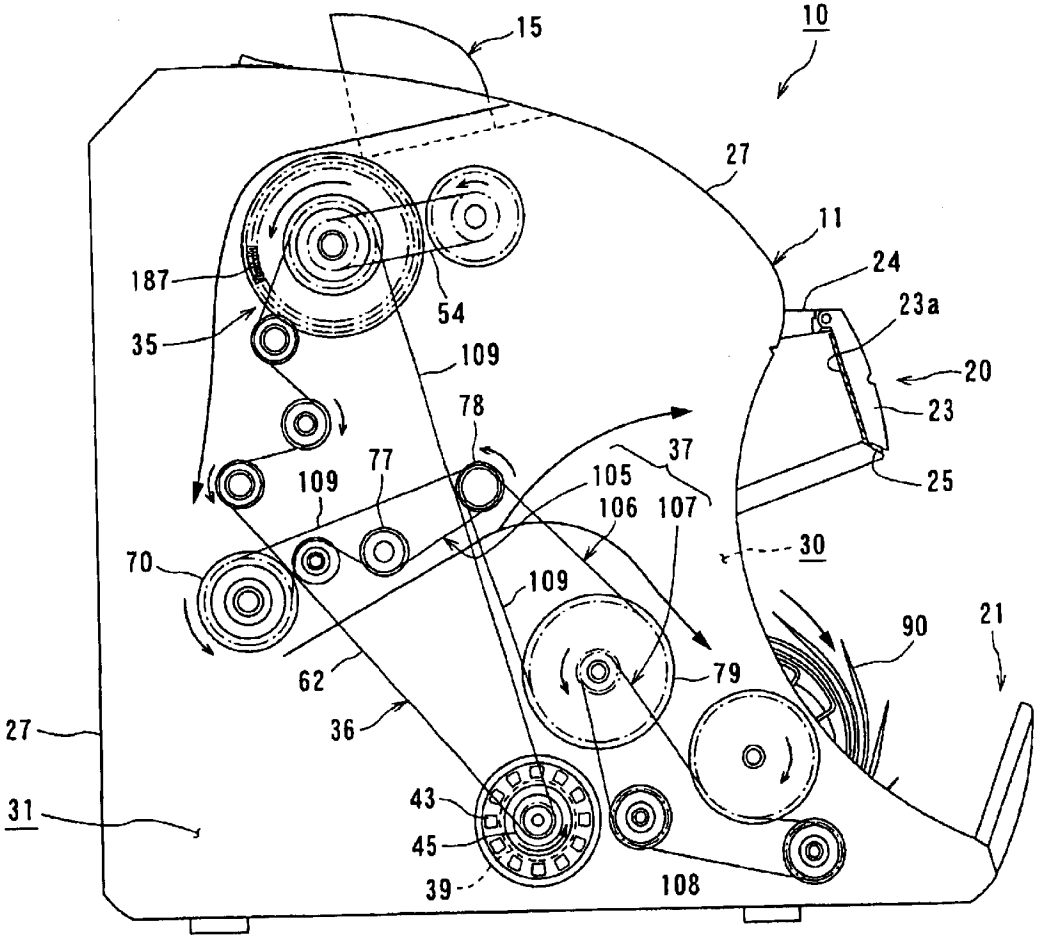
FIG. 2 is a left side elevational view showing a mechanical chamber, with a left side cover of the currency note identification counter of FIG. 1 being removed.

The counter body 11 of the currency note identification counter 10 is provided with right and left body plates 27 and 28 as seen in FIGS. 1 and 2. The currency note identification counter 10 is partitioned at its interior into a central main space 30 and right and left side spaces 31 and 32 by the right and left body plates 27 and 28. The side spaces 31 and 32 are defined between the body plates 27 and 28 and the side covers 13. One of the side spaces 31 serves as a mechanical chamber for power transmission and the other thereof serves as a control chamber for mainly providing the operation control of the currency note identification counter 10.

As can be seen in FIG. 2, the left side space 31 providing the mechanical chamber accommodates, for example, a delivery power transmission mechanism 36 for driving a sheet delivery drive system 35 and a conveyance power transmission mechanism 38 for driving a sheet conveyance drive system 37. The right-hand side space 32 providing the control chamber accommodates a part of the conveyance system power transmission mechanism 38 and three-dimensionally accommodates a circuit board (see FIG. 22) for providing a drive control of the currency note identification counter 10.

The currency note identification counter 10 has two drive sources centrally disposed on the bottom of the counter body 11. The drive sources are provided in the form of a delivery motor 39 and a conveyance drive motor 40. The drive motors 39 and 40 need not be driven in synchronism but are of the same type of motors having substantially equal motor rotational speeds. The rotational speeds of the drive motors 39 and 40 are measured by encoders 43 and 44, whilst the delivery drive motor 39 is provided with a braking device 45 such as electromagnetic brake or a mechanical brake for rapidly stopping the rotation of the motor.

Figure 3:
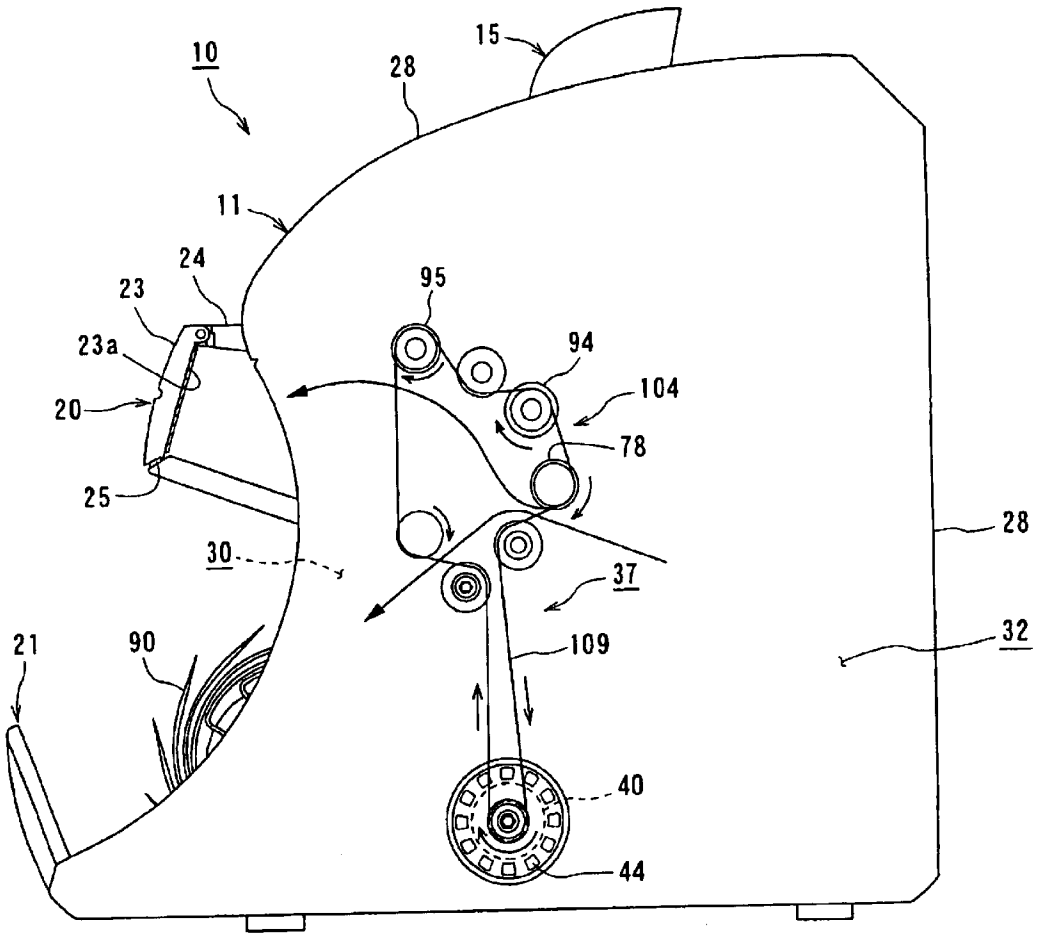
FIG. 3 is a right side elevational view showing a control chamber, with a right side cover of the currency note identification counter being removed.

For example, as shown in FIG. 3, on the other hand, the counter body 11 of the paper identification counter 10 is provided with a reflection type hopper sensor 47 provided at the bottom of the hopper 15, the hopper sensor 47 monitoring whether a stack of sheets are present or not in the hopper 15. The currency notes stacked in the hopper 15 are fed one by one by a feed mechanism into a conveyance passage 48. The feed mechanism may be a pair of rollers 50 provided at the bottom of the hopper 15. A part of the outer peripheral surface of the feed roller 50 is replaced by a friction member 51 made of urethane rubber or the like so that one rotation of the feed roller 50 can feed the bottommost note towards the passage 48 provided at the back side.

The currency notes fed from the feed roller 50 along the short length thereof is delivered from the roller or a drum 53 serving as a delivering mechanism. The delivery roller 53 and the feed roller 50 are for example a drive roller of 50 mm in diameter that is rotationally driven in unison by a timing belt 54 (see FIG. 2). To assure a secure feeding of the currency notes, a part of the outer peripheral surface of the delivery roller 54 is replaced with a friction member 55. The peripheral length of the friction member 55 is longer than that of the friction member 51 (e.g., 7 to 15 mm) formed in the feed roller 50. The delivery roller 53 and the feed roller 50 are provided with balancer weights 52 and 56 at locations confronting diametrically the friction members 51 and 55 to thereby provide a rotational balance.

The delivery roller 53 is provided sequentially with an auxiliary roller 57 acting as the friction roller, a stop roller 58 acting as the overlapped feed prevention stop member, and a pinch roller 59 acting as a pressing roller. Among these rollers, the stop roller 58 is a non-rotational roller made of,. e.g., urethane rubber having a large frictional force.

The currency notes delivered to the conveyance passage 48 by the delivery roller 53 is prevented from being doubly fed by the stop roller 58 and is given a conveyance force by the pinch roller 59 so as to be guided to a downwardly extending rectilinear conveyance passage formed at the rear portion of the counter body 11. The pinch roller 58 is pressed against the delivery roller 53 by a resilient member such as a spring or the like in order to impart a conveyance force to the currency notes.

A descending rectilinear conveyance passage 48 from the delivery roller 53 extends along the rear surface side of the counter body 11 up to the vicinity of the body lower portion and then leads to a U-shaped curvilinear transmission passage 48*b*. Provided along the rectilinear conveyance passage 48*a* are a plurality of conveyance drive rollers 60 and a conveyance driven roller 61 being in contact with the conveyance drive roller 60 in a confronting manner. The conveyance driven roller 61 is in the form of a pinch roller resiliently pressed against the conveyance drive roller 60 by a spring biasing force. The rectilinear conveyance passage 48*a* is defined by a fixed guide plate 62*a* and a movable guide plate 62*b*, and the currency notes are pinched and conveyed by the conveyance drive roller 60 and the conveyance driven roller 61.

At that time, the delivery roller 53 and the conveyance drive rollers 60 are aligned along the one side of the conveyance passage 48 and constitutes a sheet delivery drive system 35 in cooperation with the feed roller 50. The sheet delivery drive system 35 is driven in unison by the delivery system power transmission mechanism 36 of FIG. 2. The delivery system power transmission mechanism 36 is provided with a timing belt 62 or the like for providing a timing drive of the rollers.

The descending rectilinear conveyance passage 48*a* is provided with a paper identification unit 63 for identifying sheets in the form of the currency notes. The paper identification unit 63 is comprised of a variety of sensors that will be described later. The paper identification unit 63 comprises in the mentioned order a front-reverse identification sensor 63 for identifying the front or rear of the currency notes, a line sensor 65 for discriminating the denominations or discriminating whether it is normal or damaged, or detecting the adversely folded or broken notes, and a true-counterfeit identification sensor 66 for identifying the true-counterfeit of the currency notes.

The front-reverse identification sensor 64 is a reflection type optical sensor for identifying and discriminating (judging) the currency note front and reverse patterns. The front and reverse identification sensor 64 is a sensor that is necessary for the improved identification function of the currency note identification counter 10 but not indispensable.

The line sensor 65 of the paper identification unit 63 is a light transmission type sensor unit in the form of a kind identification sensor provided across the rectilinear conveyance passage 48*a* constituting the rectilinear conveyance and identification region, with a light emission side LEDs or other light sources and the light receiving side sensors confront each other with appropriate intervals therebetween of the order of several millimeters, preferably 2 to 3 mm so as to sandwich the rectilinear conveyance passage 48*a*. The line sensor 65 provides a longitudinal line scanning of the currency notes being conveyed and detects the overall surface of the notes.

The true-counterfeit identification sensor. 66 is comprised of at least one of a magnetic sensor (MG sensor) and an ultraviolet ray detection sensor (UV sensor), which are both disposed along the width of the rectilinear conveyance passage 48*a*.

A reverse feed drive roller 70 providing a U-shaped curvilinear conveyance passage 48*b* is disposed at the lower portion on the back side of the counter body 11 of the currency note identification counter 10. In order to impart a large radius of curvature to the U-shaped curvilinear conveyance passage 48*b*, the reverse feed drive roller 70 is composed of a large-diameter rubber roller. The reverse feed drive roller 70 has a diameter exceeding two third (⅔) the feed width of the sheet in the form of the currency notes, e.g., a diameter of 50 mm, the roller 70 having a diameter substantially equal to the delivery roller 53.

The U-shaped curvilinear conveyance passage 48*b* provides a curvilinear conveyance region and is defined by the reverse feed drive roller 70 and the U-shaped curvilinear guide plate 71. The curved guide plate 71 is provided in such a manner as to be displaceable between the curvilinear conveyance passage forming a setting position and an opening position, with conveyance driven rollers 72 and 73 pressed by the reverse feed drive roller 70 and disposed upstream and downstream of the curvilinear conveyance passage 48*b*. The conveyance driven rollers 72 and 73 are pinch rollers for imparting a conveyance force to the currency notes.

The U-shaped curvilinear conveyance passage 48*b* has an increased radius of curvature in order to prevent a currency note jamming, while simultaneously setting the conveyance length of the curvilinear conveyance passage 48*b* to a length enough to process the detection signals from the paper identification unit 63 and to fully absorb the time necessary to identify and judge or discriminate the currency notes.

An angled conveyance passage 48*c* is provided downstream of the U-shaped curvilinear conveyance passage 48*b*. The angled conveyance passage 48*c* has a gate timing sensor provided on the inlet side thereof. The gate timing sensor 75 is a light-transmission sensor for detecting a presence or absence of a currency note entering the angled passage 48*c*.

The angled conveyance passage 48*c* extends forward from the back side of the counter body 11 of the currency note identification counter 10 and is disposed at the lower side of the counter body 11. The angled conveyance passage 48*c* has a plurality of conveyance drive rollers 77 to 79 that are arranged along the one side thereof, e.g., along the upper side thereof. The drive rollers 77 to 79 have the same roller diameter and are rotationally driven in unison by a timing belt or the like.

The conveyance drive rollers 77 to 79 are securely mounted on the counter body 11, while movable conveyance driven rollers 81 to 83 being arranged so as to oppose to the conveyance drive rollers 77 to 79. The conveyance driven rollers 81 to 83 are resiliently brought into press contact with the conveyance drive rollers 77 to 79, respectively, so as to follow the conveyance drive rollers 77 to 79.

The angled conveyance passage 48*c* provides a reject judgment conveyance region and is defined by the fixed side guide plate 84 and the movable side guide plate 85. The passage 48*c* is sandwiched for conveyance by the conveyance drive rollers 77 to 79 and the conveyance driven rollers 81 to 83. Downstream of the angled conveyance passage 48*c* there lies a detection sensor 86 for detecting whether the currency note has passed therethrough.

The currency notes guided along the inverted-V shaped conveyance passage 48*c* is further guided by a stacker impeller 90 and is led to a stacker 21 in which they are stacked. A stacker sensor 91 detects whether any currency note is present in the stacker 21. The stacker 21 can accommodate approximately 300 to 1500 notes. The stacker sensor 91 is a transmission type sensor composed of a combined light-emission side and the light receiving side.

On the other hand, a switching gate 93 is provided at the top of the inverted-V shaped conveyance passage 48*c*. The switching gate 93 is switched in response to a sensor signal from the gate timing sensor 75. In case of discharging the currency notes that have been identified by the paper identification unit 63, the switching gate 93 detects the passage of the discharged currency notes by means of a gate timing sensor 75 and performs a switching to the reject conveyance passage 48*d* side with timing. For this purpose, the gate timing sensor 75 are fully spaced apart from the switching gate 93 in order to ensure that the discharged currency notes detected by the gate timing sensor 75 can smoothly be guided to the reject conveyance passage 48*d*.

The reject conveyance passage 48*d* diverging from the top of the inverted-V shaped conveyance passage 48*c* extends towards the pocket 20 and has a plurality of conveyance drive rollers 94 and 95 provided on one side, e.g., the upper side of the reject conveyance passage 48*d*, with conveyance driven rollers 96 and 97 confronting so as to resiliently come into press contact with the conveyance drive rollers 94 and 95.

The reject conveyance passage 48*d* diverging from the inverted-V shaped conveyance passage 48*c* extends diagonally forward to lead to the pocket 20. The reject conveyance passage 48*d* is defined by the fixed side guide plate 98 and the movable side guide plate 99. The fixed side guide plate 98 constitutes the fixed side mechanism in combination with the conveyance driven rollers 94 and 95, whilst the movable side guide plate 99 constitutes the movable side mechanism in combination with the conveyance drive rollers 94 and 95, confronting the fixed side mechanism.

A detection sensor 100 is provided on the reject conveyance passage 48*d* at the midst thereof for detecting whether the discharged currency notes have passed therethrough. The detection sensor 100 is comprised of a reflection type optical sensor. The detection sensor 100 is interposed between the fixed side conveyance drive rollers 94 and 95.

Downstream of the reject conveyance passage 48*d* there lies a guide member 101 so as to ensure a smooth guidance onto the pocket bearer 22 of the currency notes to be guided to the pocket 20. To achieve a smoother guidance of the currency notes by the pocket 20, the downstream conveyance driven roller 97 is provided with a tapping roller that extends in the tangential direction so that the currency notes can be dropped by the tapping roller into the pocket 20. The pocket 20 can accommodate approximately 100 sheets of currency notes, for example. The presence or absence of stack of the currency notes within the pocket 20 is detected by a pocket sensor 102 which is a transmission type optical sensor in combination of light emission side and the light reception side.

Figure 4:
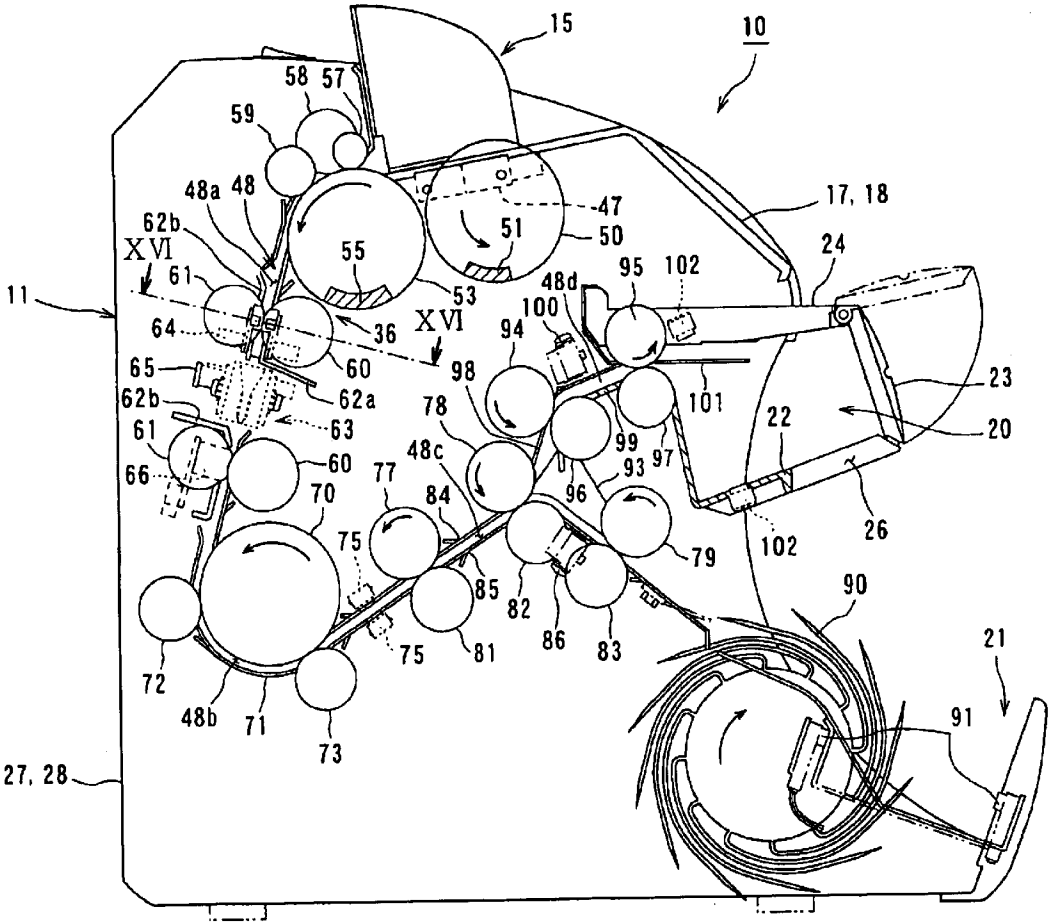
FIG. 4 is a sectional view showing a conveyance passage structure formed in the interior of the currency note identification counter depicted in FIG. 1.

The counter body 11 of the currency notes identification counter 10 includes therein a currency notes conveyance passage 48 extending from the hopper 15 to the stacker 21 as shown in FIG. 4. The conveyance passage 48 consists of a descending rectilinear conveyance passage 48*a* directed downward from the delivery roller 53, a U-shaped curvilinear conveyance passage 48*b* at the lower portion of the back side of the counter body 11, the curvilinear conveyance passage 48*b* being continuous with the rectilinear conveyance passage 48*a*, the angled conveyance passage 48*c* forwardly extending from the back side of the counter body 11 continuous with the curvilinear conveyance passage 48*b*, the conveyance passages constituting zigzag configuration to provide a sufficient conveyance length as a whole. By forming the conveyance passage 48 in a zigzag manner to achieve an effective utilization of the space within the counter body 11, a sufficient conveyance length can be obtained so as to ensure a high speed identification and counting processing of the order of 1200 to 1500 currency notes per minute, for example, which will be described later.

On the other hand, the currency note identification counter 10 has a switching gate 93 which is provided at substantially the center of the interior of the counter body 11, with the conveyance passage 48 from the hopper 15 to the stacker 21 within the counter body 11 being formed as an arcuate or U-shaped curvilinear passage with its zigzag bent portion having a larger radius of curvature in order to prevent sheets in the form of currency notes from jamming. This renders the currency note identification counter 10 small-sized and compact irrespective of the fully elongated length of the conveyance passage 48. The currency note identification counter 10 is of a desktop type of 300 mm (height)×330 mm (width)×335 mm (depth).

This currency note identification counter 10 takes into account to previously prevent jamming from occurring as a result of currency notes jamming in the conveyance passage 48. However, the currency notes as the sheets variously include not only the unused currency notes but also various currency notes such as the used currency notes or folded, damaged or broken currency notes. For this reason, jamming may occur on the way of the conveyance through the conveyance passage of the currency notes to be identified or counted, so that further conveyance of the currency notes may be prevented.

In the case of the paper jamming on the midway of the conveyance passage, the operation of the currency note identification counter 10 need to be stopped through the scramming actions. In particular, in the case of the occurrence of the jamming, the currency notes feeding side need to urgently be stopped.

For this reason, the currency note identification counter 10 as seen in FIGS. 2 and 3 comprises roughly a sheet delivery drive system 35 and a sheet conveyance drive system 37 so that the jamming can be detected by various sensors disposed on the conveyance passage. In the event of the jamming, the sheet delivery drive system 35 is brought into an urgent stop so as to prevent the currency notes from being fed.

The sheet delivery drive system 35 is driven by a rotational drive force from the drive motor 39 by way of the delivery system power transmission system 36. When there arises a paper jamming on the conveyance passage 48, a brake drive on the circuit board as will be described later is activated in response to a jamming detection signal, with the result that a brake device 45 (see FIG. 2) such as the electromagnetic brake or mechanical brake mounted on the drive motor 39 or its output is actuated, causing an urgent stop. This previously prevents the currency notes from being fed from the hopper 15 into the conveyance passage 48 at the time of jamming.

On the other hand, the sheet conveyance drive system 37 is driven by a rotational force from the drive motor 40 by way of the conveyance system power transmission mechanism 38. The conveyance system power transmission mechanism 38 mainly comprises a first conveyance power transmission system for driving the conveyance drive rollers 94 and 95 of the reject conveyance passage 48*d*, a second conveyance power transmission system 105 which is driven by way of the first conveyance power transmission system 104, and a third transmission power transmission system 107 that is driven by way of a speed reduction mechanism 106 from the first conveyance power transmission system 104. The second conveyance power transmission system 105 is provided for driving the reverse feed drive roller 70 and the conveyance drive rollers 77 and 78 of the inverted-V shaped conveyance passage 48*c*. The power transmission from the first conveyance power transmission system 104 to the second conveyance power transmission system 105 is effected via the shaft of the conveyance drive roller 78 of the inverted-V shaped conveyance passage 48*c*.

With reference to FIGS. 2 to 4, the third conveyance power transmission system 107 also receives the power by way of the speed reduction mechanism 106 from the conveyance drive roller 78 of the inverted-V shaped conveyance passage 48*c* that is driven in the first conveyance power transmission system 104. The third conveyance power transmission system 107 serves to rotationally drive the outlet side conveyance drive roller 79 and the stacker impeller 90 on the angled conveyance passage 48*c*. The outlet side conveyance drive roller 79 and the stacker impeller 90 on the angled conveyance passage 48*c* are rotationally driven in the opposite direction, so that a double (both-surface) driven timing belt is made usable. At that time, the stacker impeller 90 driven by the double driven timing belt is further driven for the speed reduction by the conveyance drive roller 79. The speed reduction ratio is appropriately set through the selection of the gear ratio.

The timing belt 109 is used for the power transmission of the delivery system power transmission mechanism 36 and the conveyance system power transmission mechanism 38. The timing belt may be replaced by the other power transmission means.

A side space (mechanical chamber) defined by the counter body 11 and the side cover 13 on one hand accommodates a part of the delivery power transmission mechanism 36 and the conveyance power transmission mechanism 38, the second conveyance power transmission system 105, the speed reduction mechanism 106 and the third conveyance power transmission system 107. The first conveyance power transmission system 104 is accommodated in the other side space providing a control chamber. These power transmission mechanisms and the power transmission systems constitute the sheet conveyance apparatus.

Figure 5:
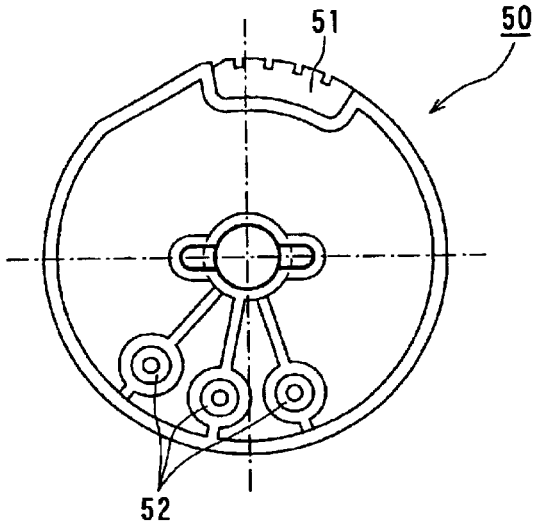
FIG. 5 shows a feed roller disposed in a feed mechanism of the currency note identification counter of FIG. 1.

The paper identification counter 10 as shown in FIG. 5 is provided with a conveyance passage opening mechanism for opening the conveyance passage.

FIG. 5 shows the back side conveyance passage opening mechanism 112 for releasing the descending rectilinear conveyance passage 48*a* of the conveyance passage 48.

Figure 7:
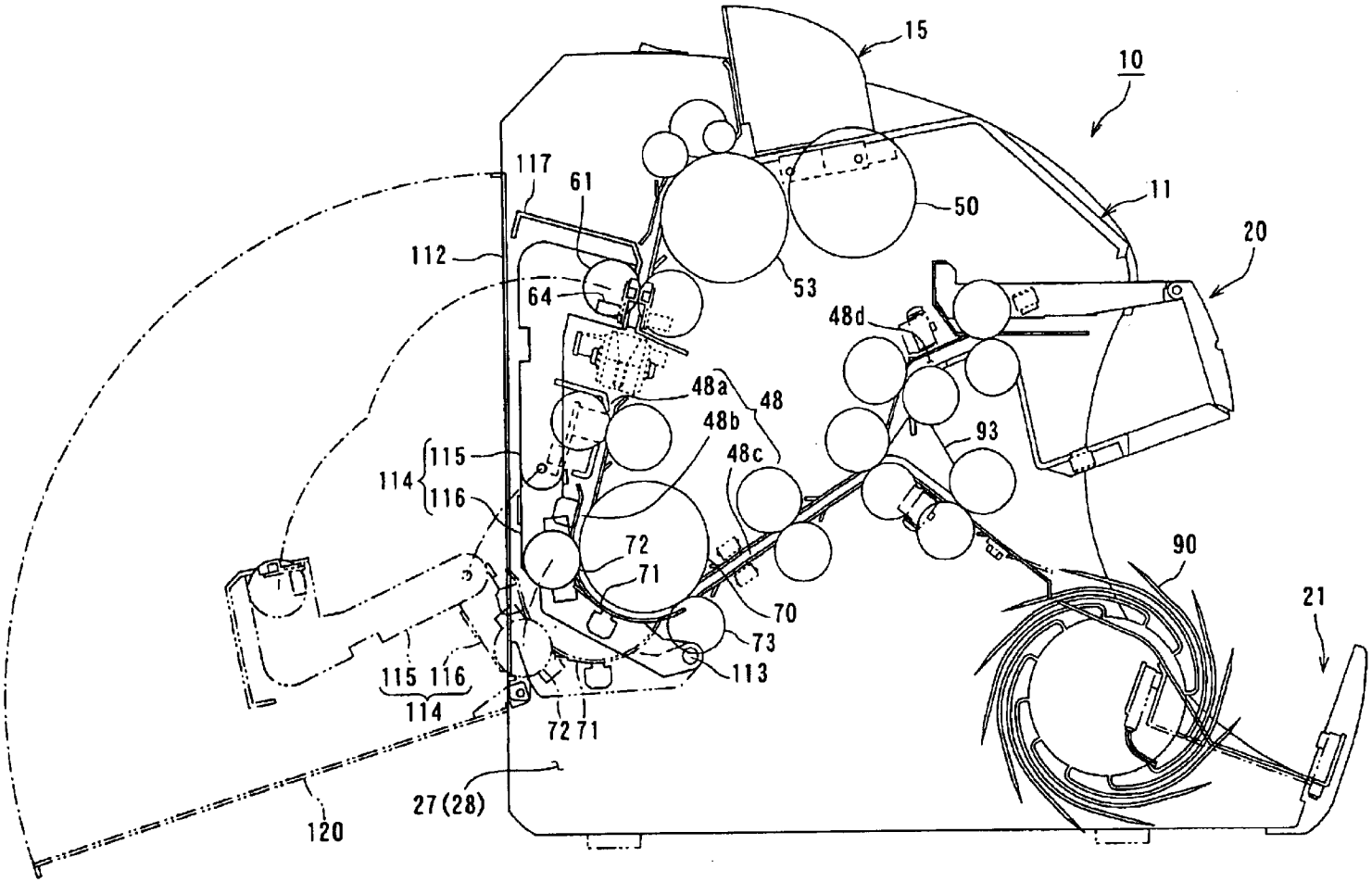
FIG. 7 is a structure diagram showing a rear door and a back side conveyance passage opening mechanism of the currency note identification counter.

Further, as shown in FIG. 7, for example, the back side conveyance passage opening mechanism 112 is an apparatus for releasing the rectilinear conveyance passage 48*a* formed on the back side of the counter body 11. The back side conveyance passage opening mechanism 112 is provided with a rear opening guide arm mechanism 114 rotatably supported around a pivot 113 provided at the back side lower portion of the counter body 11. The opening guide arm mechanism 114 comprises an upper guide arm 115 and a lower guide arm 116 which are formed in a frame structure in pair and are linked together so as to be double folded, with a hand-lever 117 being mounted on the top of the upper guide arm 115.

The upper guide 115 provides a support of the upper conveyance driven roller 61, a reflection type front-rear identification sensor 64 on one hand and the movable side guide plate 62*b*. The upper guide 115 has a wrist pin 115*a* (see FIGS. 8 and 9) that is removably locked with one touch with a lock means 118 fixedly secured to the body plates 27 and 28 of the counter body 11.

The wrist pin of the upper guide arm 115 is engaged with the lock means 118 so that the back side conveyance passage opening mechanism 112 is held at a set position indicated by a solid line in FIG. 7. The hand-lever 117 is gripped and then is pulled towards the operator in such a manner as to lift up the upper guide arm 115 to thereby simply and easily open the back side conveyance passage opening mechanism 112. The rear opening guide arm mechanism 114 of the thus opened back side conveyance passage opening mechanism 112 rotates counterclockwise in FIG. 5 around the pivot 113, while rotating the upper guide arm 115 around the link with the lower guide arm 116 to thereby open or release the rectilinear conveyance passage 48*a* to a large extent.

The lower guide arm 116 of the frame structure is provided with an inlet side conveyance driven roller 72 and a U-shaped curvilinear guide plate 71. The lower guide 116 is rotated counterclockwise in FIG. 5 around the pivot 113 so that the U-shaped curvilinear conveyance passage 48*b* can be widely opened. The opening of the U-shaped curvilinear conveyance passage 48*b* enables the currency notes jammed on the U-shaped curvilinear conveyance passage 48*b* to simply and easily be removed from the back side of the counter body 11.

In FIG. 7, reference numeral 120 denotes a rear door covering the back side of the counter body 11. The rear door 120 is supported in a freely closable and openable manner around the hinge at the back side lower portion of the counter body 11 so that, by releasing the rear door 120, the back side conveyance passage opening mechanism 112 is exposed to the back side through the opening. Then the hand-lever of the back side conveyance passage opening mechanism 112 is gripped and then is pulled towards the operator so that the back side conveyance passage opening mechanism 112 is opened from the lock position shown in FIG. 8 and then is brought into an opening position shown in the chain line in FIGS. 7 and 9.

As a result of opening the back side conveyance passage opening mechanism 112, the rectilinear conveyance passage 48*a* and the U-shaped curvilinear conveyance passage 48*b* are opened to the back side of the counter body 11. The opening sensor enables the currency notes jammed in the rectilinear conveyance passage 48*a* or the U-shaped curvilinear conveyance passage 48*b* to be simply and easily removed.

After the removal of the currency notes from the conveyance passage 48, the back side conveyance passage opening mechanism 112 is set to a setting position shown in a solid line by performing the inverse operations to the procedures of the opening actions of the back side conveyance passage opening mechanism 112, after which it can be reset for the identification and counting for the next currency notes.

At that time, the conveyance passage 48 from the hopper 15 is curved at the delivery roller 53 and continues with the rectilinear conveyance passage 48*a*. Then the rectilinear conveyance passage 48*a* is led from the upper side portion towards the lower side portion along the back side of the counter body 11 and is positioned near the rear door 120. Due to the positioning near the rear door, when the back side conveyance passage opening mechanism 112 is opened, the rectilinear conveyance passage 48*a* and the U-shaped curvilinear conveyance passage 48*b* are caused to be opened to a large extent. This allows a simple and easy removal of the currency notes jammed in the rectilinear conveyance passage 48*a* and the U-shaped curvilinear conveyance passage 48*b*.

Figure 10:
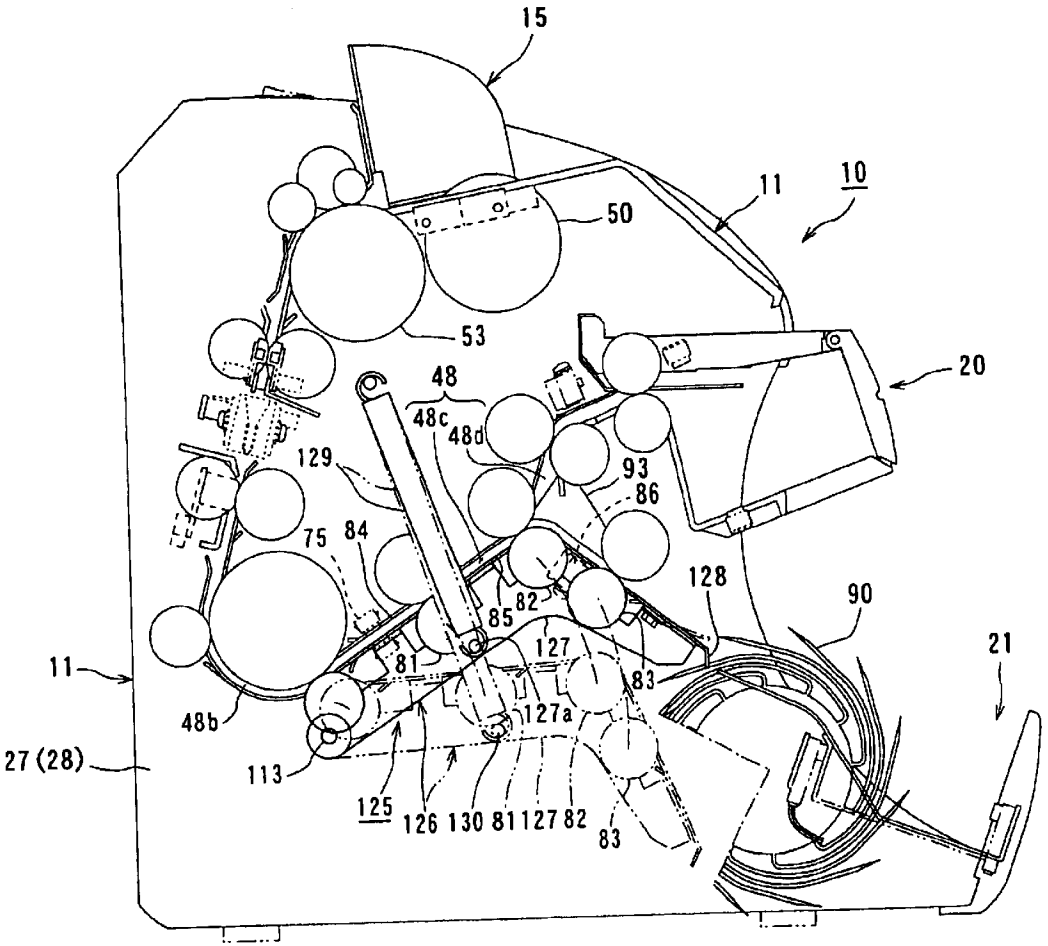
FIG. 10 shows the state of opening and closing an angled conveyance passage opening mechanism incorporated in the paper identification counter.

The currency note identification counter 10 as shown in FIG. 10 comprises an angled conveyance passage opening mechanism 125 for releasing the angled conveyance passage 48*c* that is a downstream conveyance passage within the counter body 11. The angled conveyance passage 48*c* extends from the outlet side of the U-shaped curvilinear conveyance passage formed at the back side lower portion of the counter body 11 in front of the counter body 11 and then is led to the stacker 21 by way of the stacker impeller 90.

The angled conveyance passage 48*c* is fashioned into an inverted-V by the combination of the upper fixed side guide plate 84 and the lower movable side guide plate 85. The movable side guide plate 85 is attached to a front opening guide arm mechanism 126 pivotally supported on a pivot 113. The opening guide arm mechanism 126 is provided with a movable guide arm 127 of an angled frame structure with a smooth side surface.

The movable guide arm 127 is pivotally supported on the pivot 113 common to the back side conveyance passage opening mechanism 112 and is held at a setting position indicated by a solid line, normally by a spring biasing force, not shown. The movable guide arm 127 of the frame structure is provided with a wrist pin 130 that extends through the elongated hole of the body plates 27 and 28 and that is spring biased upward by the spring 129.

The movable guide arm 127 of the angled conveyance passage opening mechanism 125 is provided with angled movable side guide plate 85, conveyance driven rollers 81, 82, 83 in forms of a roller train, a gate timing sensor 75 and an optical reflection type detection sensor 86, respectively. A hand-lever 128 extends from the free end of the movable guide arm 127. The hand-lever 128 extends forward between the stacker impeller pair 90 so that it can be operated from the front.

In the case of this currency note identification counter 10, by inserting the operator's hand into the stacker impeller 90, the hand-lever 128 of the angled conveyance passage opening mechanism 125 is pressed down against the spring force of the spring 129. By pressing down the hand-lever 128, the opening guide arm 126 is pivoted about the pivot 113 to cause the angled conveyance passage 48*c* to open forward to a great extent as shown with the a chain line in FIG. 10.

With the angled conveyance passage 48*c* opened forward to a large extent, the currency notes jammed in the angled conveyance passage 48*c* can be removed forward. When the hand-lever is released, after the forward removal of the currency notes, the front opening guide arm mechanism 126 can automatically be returned to a set position indicated by a solid line in FIG. 10 by a spring force of the spring 129.

The currency note identification counter 10 further comprises as shown in FIG. 10 (11), a reject conveyance passage opening mechanism 130 for releasing the reject conveyance passage 48*d*.

The reject conveyance passage opening mechanism 130 is provided with an opening guide arm mechanism 132 which is pivoted about the pivot 131. The pivot 131 is disposed at the center lower portion of the counter body 11, the pivot 131 having an L-shaped guide arm 134 that is provided rotatably between the setting position indicated by the solid line and the opening position indicated by the chain line in the side elevation of FIG. 10.

The guide arm 134 of the opening guide arm mechanism 132 has an elongated curved arm length and is provided with a pocket 20 at the arm free end portion side. More specifically, the pocket bearer 22 of the pocket 20 is mounted on the upper portion of the paired curved guide arms 134. On the other hand, the conveyance driven rollers 96 and 97 of the reject conveyance passage 48*d* are rotatably supported on the guide arm 134. At the free end side of the guide arm 134, is attached a movable guide plate 99 that confronts the fixed side guide plate 99 positioned above so as to define the reject conveyance passage 48*d* between the two guide plates 98 and 99.

Figure 12:
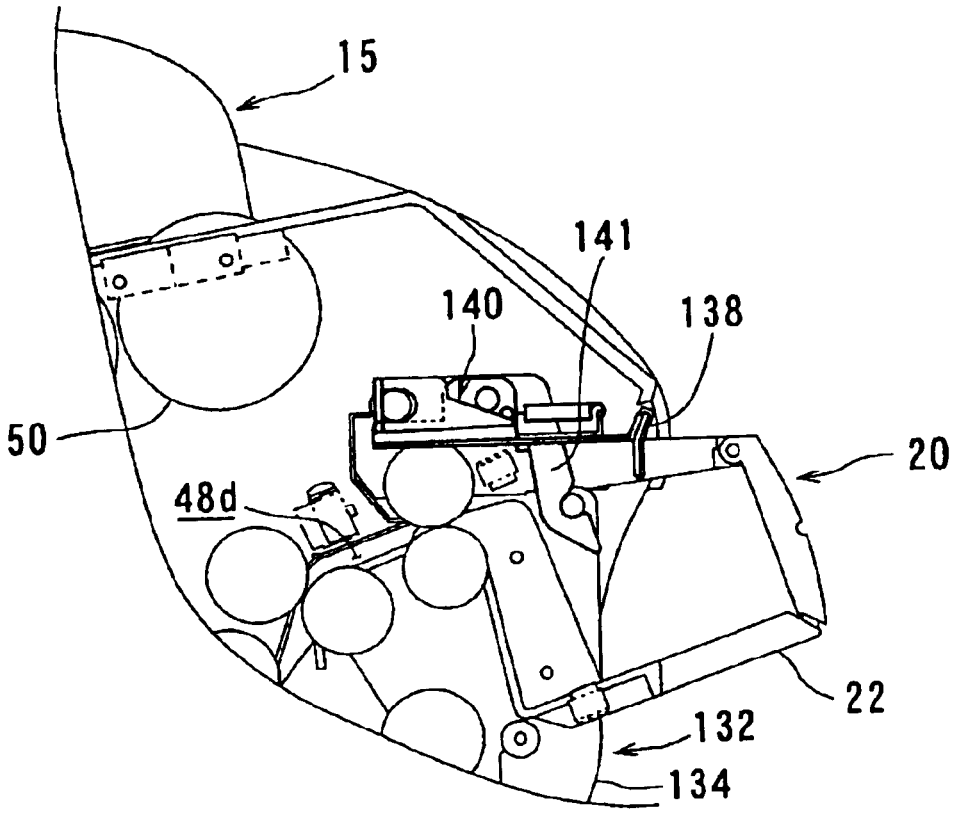
FIG. 12 shows the locked state of a pocket release cam mechanism for releasably locking the reject conveyance passage opening mechanism.
Figure 13:
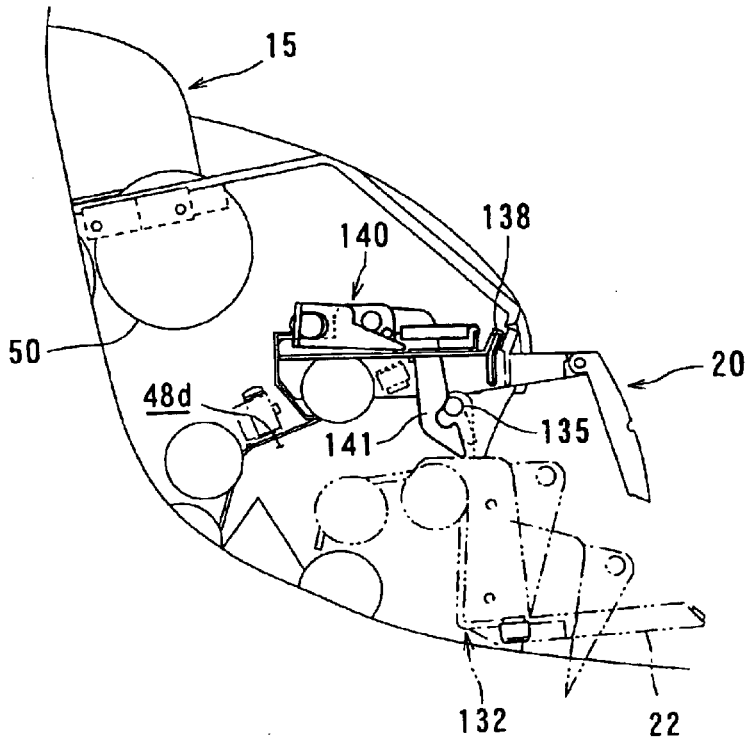
FIG. 13 shows the unlocked state of the pocket release cam mechanism.
Figure 14:
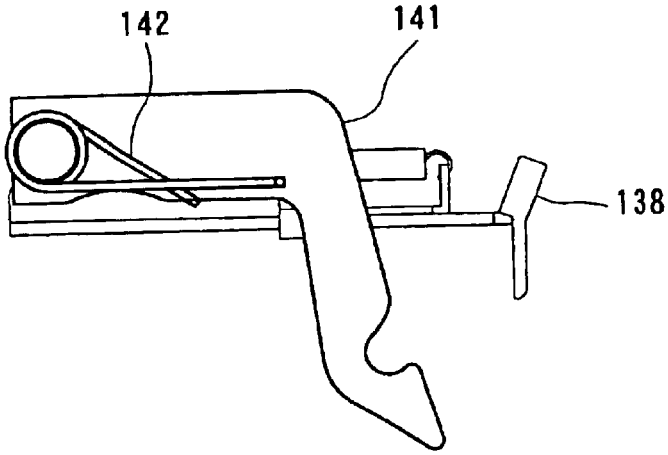
FIG. 14 shows an engagement hook of the pocket release cam mechanism.
Figure 15:
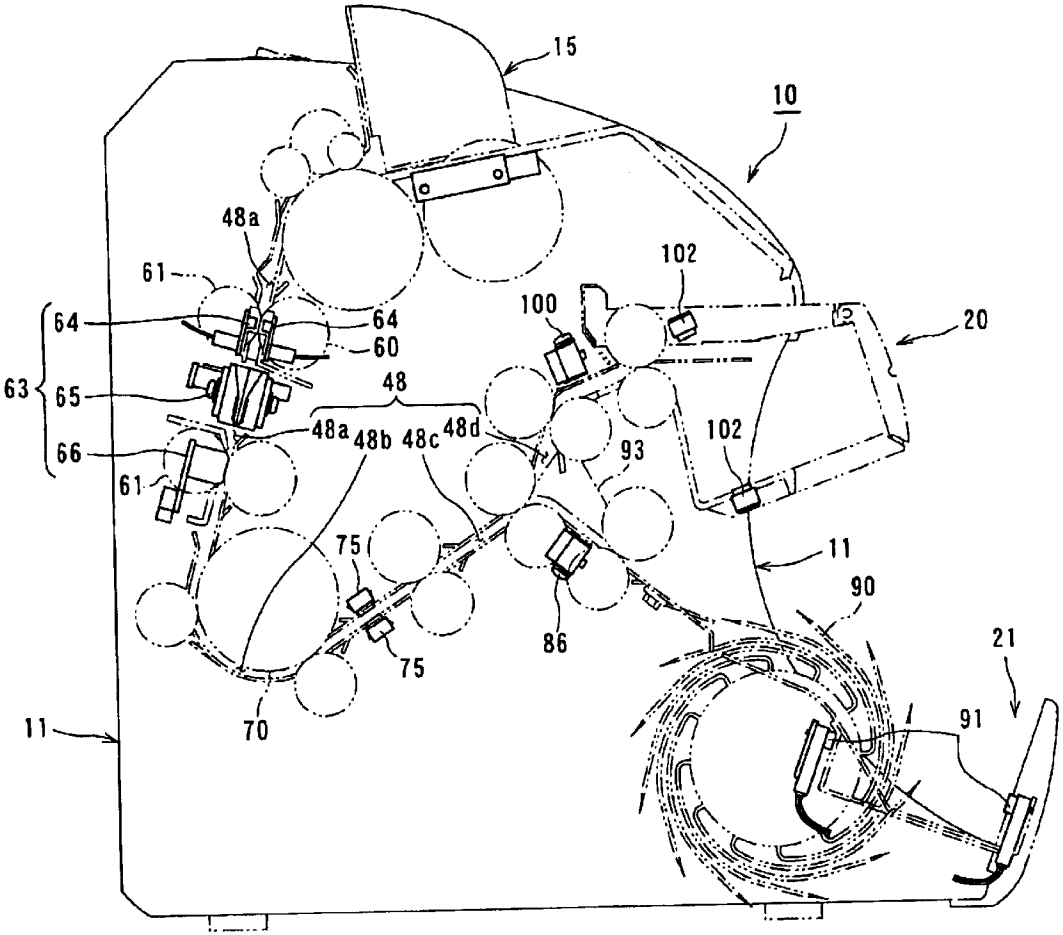
FIG. 15 shows a conveyance passage structure and a sensor arrangement structure that are formed in the interior of the currency note identification counter depicted in FIG. 1.

The reject opening guide arm mechanism 132 includes a bridge pin 135 which bridges the free ends of the paired guide arms 134 as shown in FIGS. 12 and 13, the bridge pin 135 acting as an engagement member. The bridge pin 135 is lock supported by an engagement hook 141 mounted on the counter body 11 so that the opening guide arm mechanism 132 is held at the setting position indicated by a solid line.

In case of releasing the opening guide arm mechanism 132, the operation button 138 provided above the pocket 20 is pressed as shown in FIGS. 1, 12 and 13 so that the engagement hook 141 is rocked by way of a cam mechanism 140 to thereby release the bridge pin 135 from the engagement hook 141. The release of the bridge pin 135 results in a lock release of the opening guide arm mechanism 132 which in turn rotates clockwise by its own weight and is brought into a reject conveyance passage opening position as indicated by a chain line in FIG. 13.

When the opening guide arm mechanism 132 is opened, the pocket bearer 22 forming the lower portion of the pocket 20 moves downward to be opened forward to a large extent, so that currency note identification counter 10 allows the front side pocket 20 to be opened downward to a large extent. In this context, the opening guide arm mechanism 132 serves also as a mechanism for releasing the reject conveyance passage 48*d* and simultaneously for releasing the pocket 20 downward.

The opening operation of the opening guide arm mechanism 132 allows the reject conveyance passage 48*d* to be opened forward to a large extent by way of the thus opened pocket 20, making it possible for the currency notes jammed in the reject conveyance passage 48*d* to be retrieved and removed through this opening.

At that time, the opened guide arm mechanism 132 of the reject conveyance passage opening mechanism 130 is provided with a guide arm 134 having an elongated arm length, and the guide arm 134 can rotate to a large extent around the pivot at the lower portion of the counter body 11, whereby the opening action of the opening guide arm mechanism 132 enables the currency notes jammed in the reject conveyance passage 48*d* to be simply and easily retrieved and removed.

Figure 11:
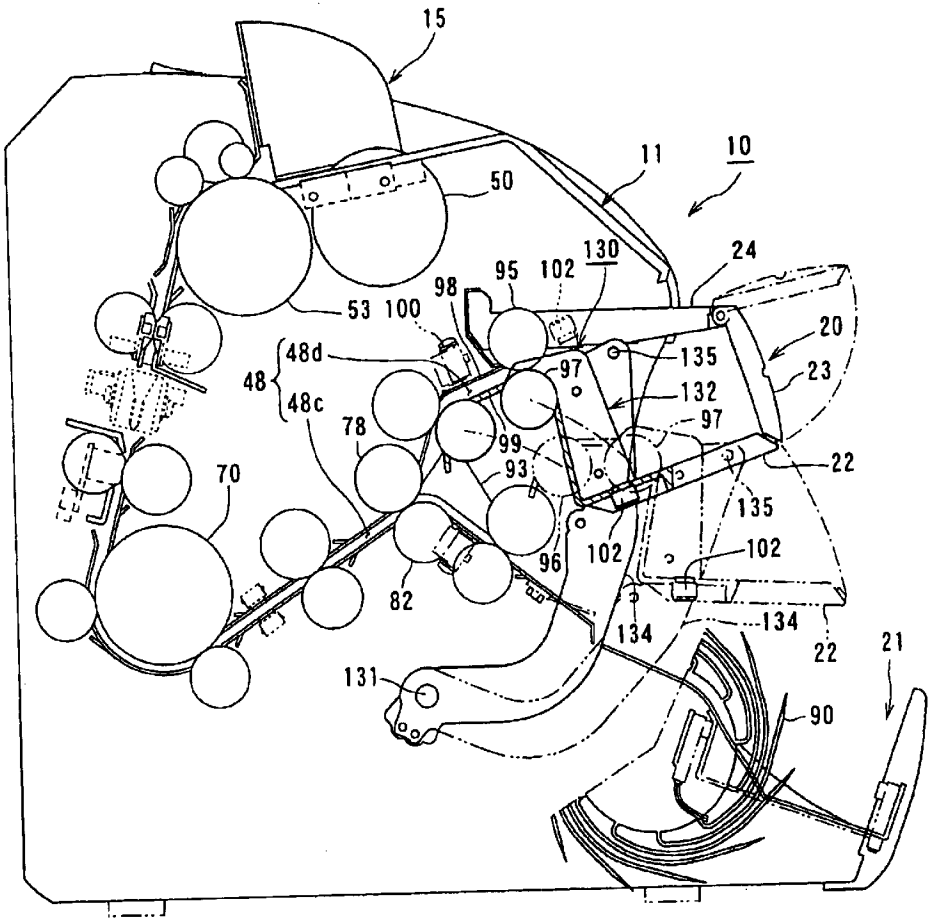
FIG. 11 shows the state of opening and closing of a reject conveyance passage opening mechanism incorporated in the paper identification counter.

In the case of recovering the reject conveyance passage 48*d* of the reject conveyance passage opening mechanism 130, the pocket bearer 22 of the pocket 20 may be pushed up from the opening position indicated by the chain line and brought into a setting position indicated by the solid line in FIG. 11. When the pocket bearer reaches the position indicated by the solid line, the bridge pin 135 at the end of the guide 134 is brought into engagement with the engagement hook 141 for being set at the setting position. The engagement hook 141 is at all times spring biased by the spring 142 so as to hold the bridge pin 135 in the engaged state.

As seen in FIGS. 7 and 10–12, the currency note identification counter 10 comprises the back side conveyance passage opening mechanism 112, the angled conveyance passage opening mechanism 125 and the reject conveyance passage opening mechanism 130 which are independently opened.

The back side conveyance passage opening mechanism 112 can open the rectilinear conveyance passage 48*d* and the U-shaped curvilinear conveyance passage 48*b* towards the back side to a large extent. The angled conveyance passage opening mechanism 125 opens the angled conveyance passage 48*c* towards the front side to a large extent and the reject conveyance passage opening mechanism 130 opens the reject conveyance passage 48*d* towards the front side to a large extent, whereby it is possible to simply and easily remove the currency notes jammed on the way of the conveyance passage 48.

Incidentally, the reject conveyance passage opening mechanism 130 serves also as a pocket opening mechanism so that, by releasing the reject conveyance passage opening mechanism 130, the pocket bearer 22 under the pocket 20 can be moved downward and be opened to a large extent. It is thus possible to retrieve and remove the currency notes jammed in the reject conveyance passage 48*d* through the opening of the pocket 20. In case of the currency note identification counter 10 shown in FIGS. 3 to 7, one side of the conveyance passage 48 formed in the counter body 11 is arranged as the drive side, while the other side is arranged as the driven side.

The drive side of the currency note identification counter 10 includes a feed roller 50, a delivery roller 53, conveyance drive rollers 60 of the rectilinear conveyance passage 48*a*, the reverse feed drive roller 70, the conveyance drive rollers 77 and 78 of the angled conveyance passage 48*c*, and the conveyance drive rollers 94 and 95 of the reject conveyance passage 48*d*, all the above rollers being provided collectively so as to be positioned at the center side of the counter body 11 within the inside of the conveyance passage 48. Thus, effective arrangement can realize the power transmission system for driving the rollers on the drive side.

In addition, the driven side structure of the currency note identification counter 10 includes the rollers which are arrayed on the outside of the conveyance passage 48 so as to make easy the handling of the conveyance passage opening mechanisms 112, 125 and 130.

In this currency note identification counter 10, the drive side rollers and the driven side rollers are arrayed in a roller train along conveyance passage 48 extending from the hopper 15 to the stacker 21 or the pocket 20. The intervals of the roller array of the drive side rollers and the driven side rollers are set to be smaller than the length in the shorter-side direction, i.e., the feed width of the sheet in the form of the currency notes.

Figure 8:
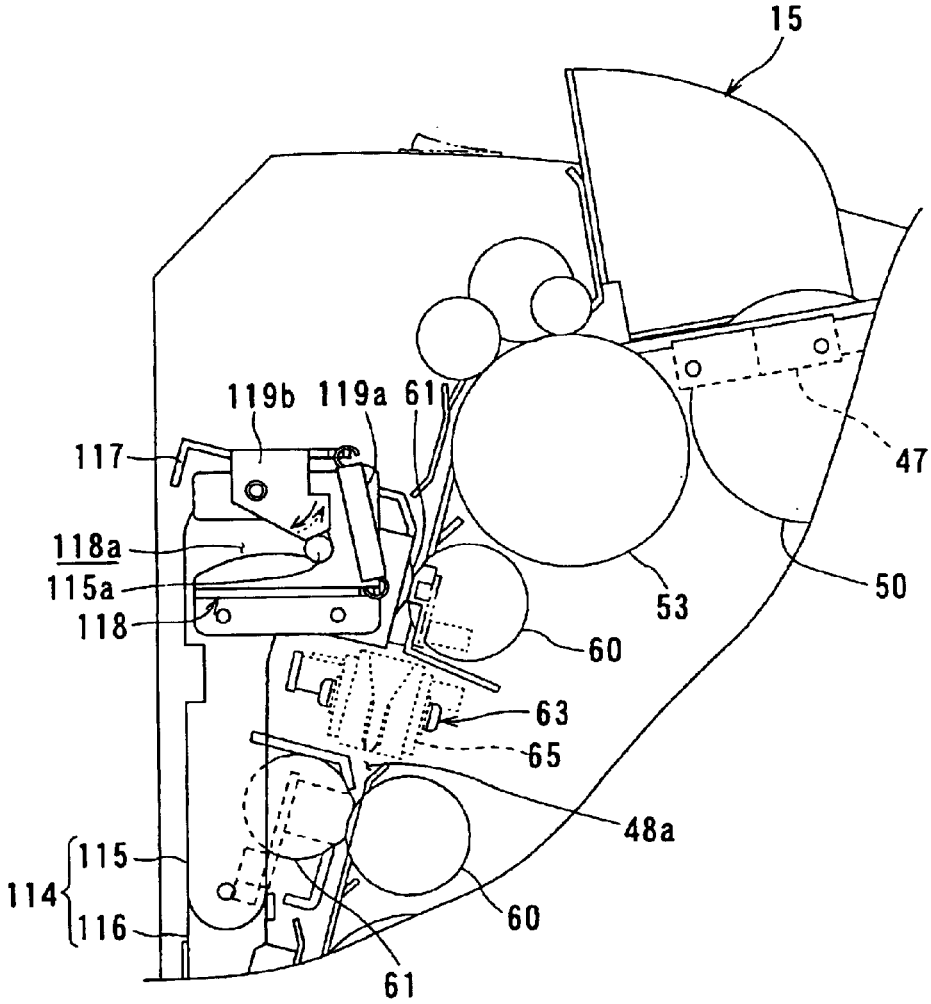
FIG. 8 illustrates the back side conveyance passage opening mechanism being locked, provided in the currency note identification counter.

FIG. 8 is a view showing the relationship of the arrangement of the conveyance passage 48 of the currency note identification counter 10 and of the various sensors that are located along the conveyance passage 48.

A hopper sensor 47 is provided on the hopper 15 into which sheets in the form of the currency notes are fed, the hopper sensor 47 being a reflection type optical sensor for detecting whether the currency notes are present on the bottom or not.

A paper identification unit 63 is provided on the rectilinear conveyance passage 48*a* of the conveyance passage 48. The paper identification sensor 63 includes, from the upstream side to the downstream side, a front-reverse identification sensor 64, a line sensor 65 acting as the kind discrimination sensor for performing the discrimination (judgment) of the kind of the currency notes, judgement of the normal or damaged, or judgment of the folded currency notes, and a true-counterfeit identification sensor 66 for judging the true-counterfeit of the currency notes.

The front-reverse sensor 64 is e.g., a reflection type optical sensor arranged to individually judge or discriminate the front or reverse of the currency notes on each side of the conveyance passage. The front-reverse identification sensor 64 is not necessarily an inevitable identification sensor, but a sensor necessary for the judgment of the front or reverse of the currency notes. In the case of using the reflection type optical sensor as the front-reverse identification sensor 64, it is desired to arrange the sensor surfaces so as to be substantially level with the roller surfaces in order to ensure an improved sensor sensitivity. However, the confronting arrangement of the paired front-reverse identification sensors 64 may often result in the occurrence of paper jamming. For this reason, the optical sensors arranged on both sides of the conveyance passage 48 are offset relative to and spaced apart from each other in the shorter-side direction of the conveyance passage in order to achieve an effective prevention of the currency notes jamming.

The line sensor 65 is interposed between the upstream paired drive-driven conveyance rollers 60 and 61 and the downstream paired drive-driven conveyance rollers 60 and 61. A line sensor 65 is arranged so as to cross the conveyance passage 48 as will be described later, for scanning the overall surfaces of the currency notes being fed to the rectilinear conveyance passage 48*a*.

On the other hand, the true-counterfeit judgment sensor 66 is comprised of magnet sensors (MG sensors) and UV sensors for identifying and judging the true-counterfeit of the currency notes. The magnet sensors and the UV sensors are arranged along the conveyance passage 48 in the shorter-side direction thereof, although both the magnet sensors and the UV sensors need not necessarily be provided and either one may be provided.

A gate timing sensor 75 is provided downstream of the reverse feed drive roller 70. The gate timing sensor 75 is a transmission type optical sensor serving to detect whether the currency notes have passed or not and provide a gate action instruction as its output to the switching gate 93. The gate timing sensor 75 is disposed as near the reverse feed drive roller 70 as possible so as to assure a distance between the gate timing sensor 75 and the switching gate 93. This is because a time sufficient for the switching the switching gate 93 must be secured. In this context, the gate timing sensor 75 is provided at the inlet side of the angled conveyance passage 48*c*.

A detection sensor acting as the stacker entrance detection sensor is provided in the outlet side region of the angled conveyance passage 48*c*. The stacker entrance detection sensor 86 is e.g., a reflection type optical sensor disposed at the downstream side of the switching gate 93.

The currency notes fed through the angled conveyance passage 48*c* is guided by the stacker impeller 90 and is fed to the stacker 21 in which they are stacked. The stacker 21 can accommodate e.g., approximately 300 to 1,500 currency notes. The stacker 21 is provided with a transmission type stacker sensor 91 for detecting whether a stack of sheets are present or not in the stacker 21.

A reject conveyance passage 48*d* diverges from the top of the angled conveyance passage 48*c* and is provided with a detection sensor 100 acting as the pocket entrance detection sensor. The pocket entrance detection sensor 100 is a reflection type optical sensor provided downstream of the switching gate 93, for detecting the presence or absence of the currency notes to be fed to the pocket 20.

The currency notes to be fed to the pocket is guided by the guide member 101 and is led to the pocket 20 in which they are stacked. The pocket can accommodate approximately 100 to 300 sheets of currency notes. The pocket 20 is provided with a pocket sensor 102 for detecting the presence or absence of the currency notes to be stacked. The pocket sensor 102 is a transmission type optical sensor.

Figure 17:
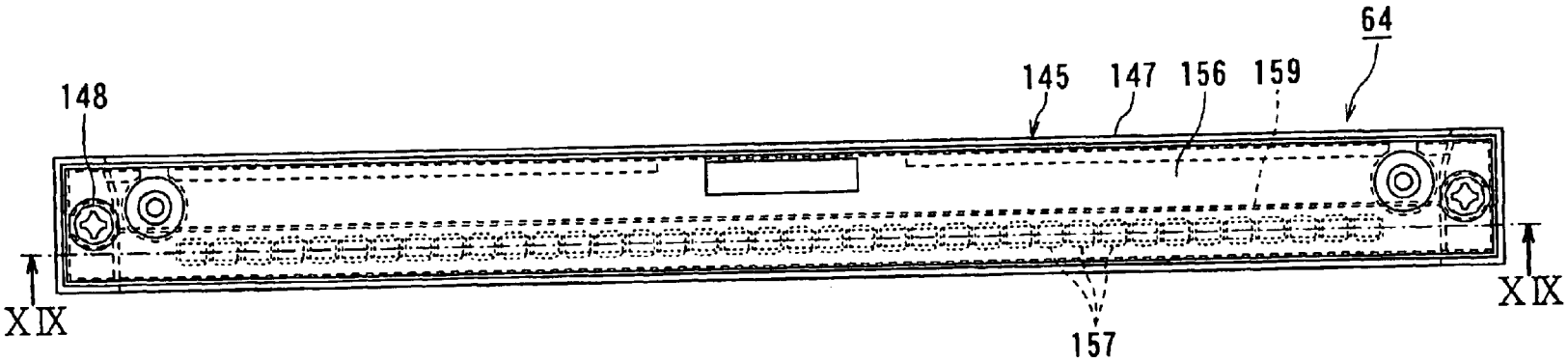
FIG. 17 is a top plan view of a paper identification unit in the form of a line sensor, incorporated in the currency note identification counter.
Figure 18:
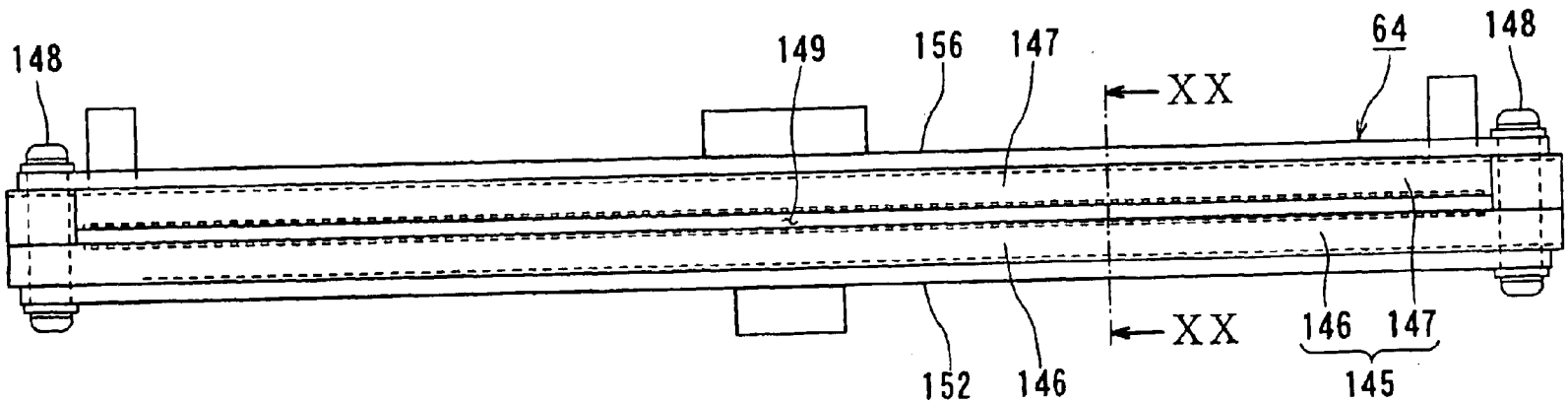
FIG. 18 is a front elevational view of the line sensor depicted in FIG. 17.
Figure 19:
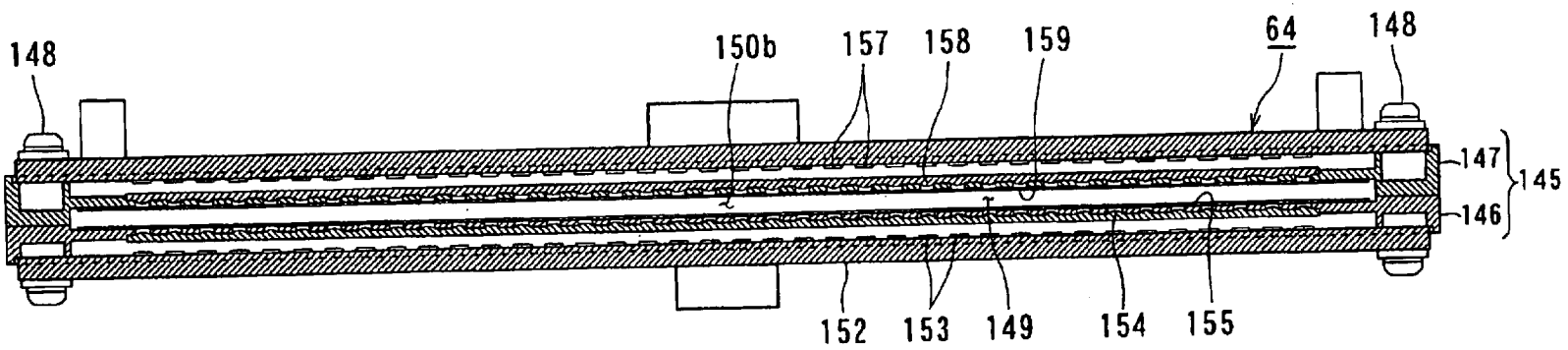
FIG. 19 is a view taken along a line XIX-XIX of the line sensor depicted in FIG. 17.

In this manner, the currency note identification counter 10 includes a sensor group consisting of various sensors which are arranged, as occasion demands, along the conveyance passage 48, with a line sensor 65 constituting the paper identification unit 63 being arranged as shown in FIGS. 17 to 20. The line sensor 65 has a detection width allowing a scanning over the overall surface of the currency notes, taking into consideration easiness of handling of the currency notes of the worldwide nations having different patterns or sizes. FIGS. 17 to 19 show the line sensor 65 which is incorporated in the currency note identification counter 10 but may be incorporated as an identification unit for currency notes identification and judgment or discrimination into ticket machines or automatic vending machines.

Figure 16:
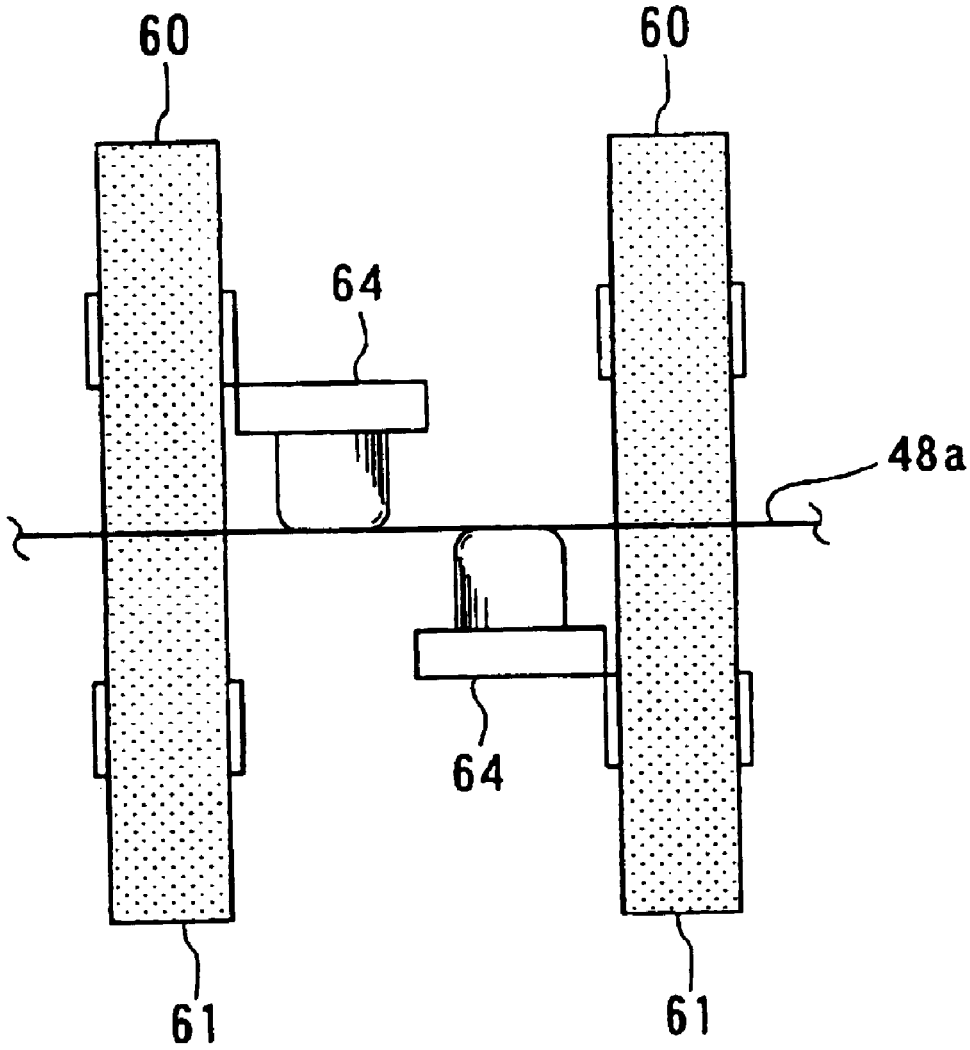
FIG. 16 is a view taken along a line XVI-XVI, showing a reflection type front-reverse identification sensor incorporated in the currency note identification counter.

The front-reverse identification sensors 64 constituting the paper identification unit 63 are arranged in pair on the both surfaces of the rectilinear conveyance passage 48*a* as shown in FIG. 16. The paired front-reverse identification sensors 64 are offset relative to each other in the shorter-side direction of the conveyance passage 48*a* and are spaced in vicinity of each other with intervals of the order of e.g., 10 mm. The front-reverse identification sensor 63 detects the front or reverse of the currency notes passing through the rectilinear conveyance passage 48*a* by use of the amount of reflected light and identifies the front or reverse patterns of the currency notes from the difference in the amount of reflected light to thereby judge the front or reverse of the currency notes.

The line sensors 65 constituting the paper identification unit 63 are arranged on the upstream side and the downstream side of the conveyance drive rollers 60 and the conveyance driven rollers 61 so as to traverse:the same. The line sensor 65 has an elongated block-like sensor body 145 as shown in FIGS. 17 to 19. The sensor body 145 can be split into two halves, i.e., a light emission side sensor member 146 and a light reception side sensor member 147. The members 146 and 147 are combined in a confronting manner and are fastened together by means of a fastening means 148 so as to be assembled into an integral part.

Figure 20:
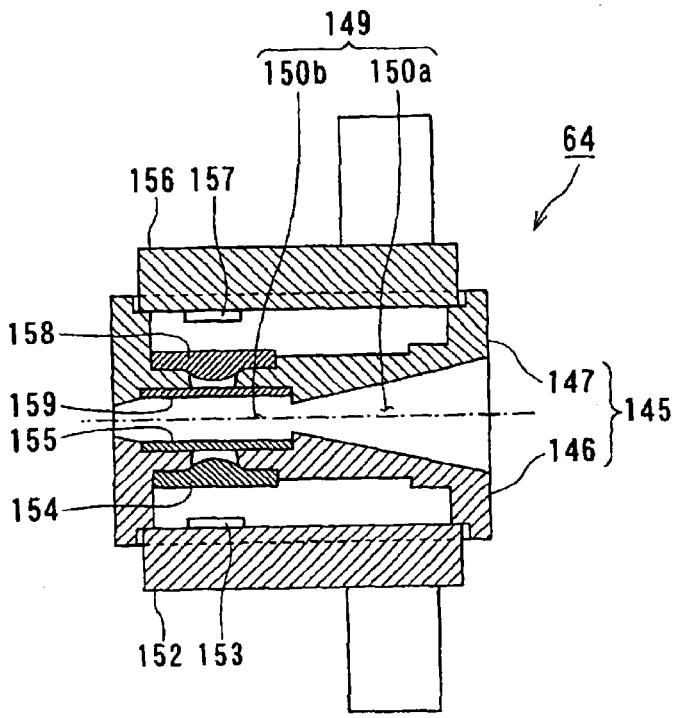
FIG. 20 is a sectional view taken along a line XX—XX of the line sensor depicted in FIG. 18.

The sensor body 145 is formed with a guide passage 149 that is disposed between the two sensor members 146 and 147 for guiding sheets in the form of currency notes. The guide passage 149 consists of an upstream side tapered guide passage 150*a* and a downstream side parallel slit-like guide passage 150*b* as shown in FIG. 20. The tapered guide passage 105*a* has a height that is gradually reduced from the upstream towards the downstream and leads smoothly to the slit like guide groove 150*b*. The slit like guide passage 150*b* has a gap of the order of several millimeters, e.g., 2 to 3 mm, preferably of the order of 2 mm.

The light emission side sensor member 146 of the sensor body 145 has a light emission substrate 152 provided, at its back side, with light emission elements such as infrared LEDs or the source of laser lights disposed on the light emission substrate 152. A number of, for example, 38 light emission elements 153 are arrayed in the longitudinal direction at a predetermined pitch of e.g., 5 mm. The light emission element 153 is a spot like light source. Further, it is not always necessary for the light emission side sensor member 153 to have a spot like configuration and, not a line-like configuration.

The light emission side sensor member 146 is provided with a plate-like lens member 154 that collimates a light from the spot-like light emission element 153. The lens member 154 forms a lens group consisting of a number of, e.g., 38 lenses that are integrally arrayed in a train with a predetermined pitch. The lenses of the lens member 154 are disposed in a manner so as to confront the spot-like light emission element 153. The lens member 154 is covered with a transparent cover plate 155 such as a cover glass that is exposed to the slit-like guide passage 150*b*.

On the other hand, the light reception side sensor member 147 confronting the light emission side sensor member 146 is also provided -at its back side with a light reception substrate 156 on which light reception elements 157 such as photodiodes or CCDs are arrayed. The light reception side sensor member 147 equipped with the light reception substrate 156 is provided with a lens member. 154 of the light emission side sensor member 146, a lens member 158 similar to the cover plate 155, and a transparent cover plate 159. The transparent cover plate 159 is arranged confronting the cover plate 155 and has a slit-like guide passage 150*b* formed between the two cover plates 155 and 159. The slit-like guide passage 150*b* thus provides a check and detection region for the currency notes guided through the guide passage 149.

The lens member 158 of the light reception side sensor member 147 scans and condenses on an element surface of the light reception element 157 a transmission light that is emitted from each light emission element 153 of the light emission side sensor member 158 and that is collimated by the lens member 154, thereby ensuring a light reception of a sufficient quantity of light by the light reception element 157. The light reception elements 157 are arrayed confronting each other in line. Thus, these light emission elements 153 and the light reception element 157 constitute the light emitter and the light receptor, which build up a transmission type light detector in cooperation.

That is, the line sensor 65 constitutes a transmission type light detector and provides a detection width enough to scan the overall surface of the currency notes of the worldwide currency notes having different patterns and sizes.

In the case of scanning the overall surface of the currency notes by means of the line sensor 65, it is preferred to scan the currency notes as close to the detectors as possible in order to ensure an easy detection of the variance of density of light and to obtain a stable scanning data. For this purpose, the height of the slit-like guide passage 150*b* of the guide passage 149 is made as narrow as possible so that the currency notes can be guided through the gap defined therebetween, whereby the currency notes can intimately adhere to the detector and a stable scanning data are obtained.

However, the actual currency notes include notes in various conditions such as folded currency notes, corner folded currency notes, used currency notes, new currency notes, so that the narrowed slit-like guide passage 150*b* may occur the currency notes jamming in the detector. The narrowed gap of the guide passage 149 for guiding the currency notes will need any measures against the currency notes jamming. Ideally, the height (gap) of the guide passage 149 is preferably equal to the height (gap) of the rectilinear conveyance passage 48*a*.

By the way, if the gap between the light emission side and the light reception side is increased in a typical transmission type light detector, the density of the transmission light will vary depending on the height of the passage of the currency notes from the light receptor, and hence, it will become hard to obtain desired scanning data on the currency notes.

The line sensor 65 shown in FIGS. 17 to 20 iterates the line scanning to scan the overall surfaces of the currency notes, which will make it difficult to provide a feed roller such as a rubber roller within the slit-like guide passage 150*a* which provides a detection/check region. That is, it is difficult to dispose, in the line sensor 65, the means for preventing any disturbance of the currency notes during the scanning.

Taking this situations into consideration, the line sensor 65 shown in FIGS. 17 to 20 allows the lens members 154 to collimate the diffused light from the light emission light 153 into a parallel light for transmission, to thereby prevent any variation of the quantity of light (variation in the strength of emission) arising from the difference of the currency notes detection distance. On the contrary, even though the chip size of the light reception element 157 is made smaller, the light reception element 157 side is also provided with the lens member 158 so as to prevent any variations in the change of light reception quantity, whereby the collimated light is condensed through the lenses of the lens member 158 so that the variance of the output arising from the change of the light reception quantity can be suppressed.

Figure 21:
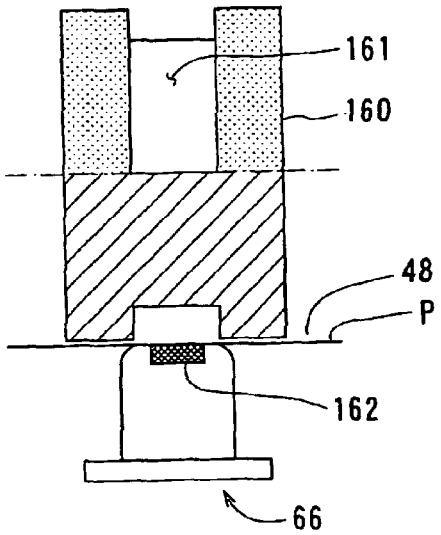
FIG. 21 shows a false-counterfeit identification sensor in the form of a magnetic sensor (MG sensor) of the paper identification unit.

The true-counterfeit identification sensor 66 disposed downstream of the light sensor 65 is for example a magnetic sensor which is provided in pairs in the shorter-side direction of the conveyance passage 48. The magnetic sensor is arranged confronting the sensor roller 160 as shown in FIG. 21, With the sensor head 162 of the magnetic sensor being positioned within a peripheral groove 161 of the sensor roller 160. The sensor head confronts the currency notes P guided through the conveyance passage 48 in such a manner as to come as closer as possible and be able to come into contact therewith. The magnetic sensor may be replaced by an UV sensor using the ultraviolet rays. Furthermore, the UV sensor may be used with the magnetic sensor so that it is interposed between the paired magnetic sensors or disposed downstream of the magnetic sensor.

Figure 22:
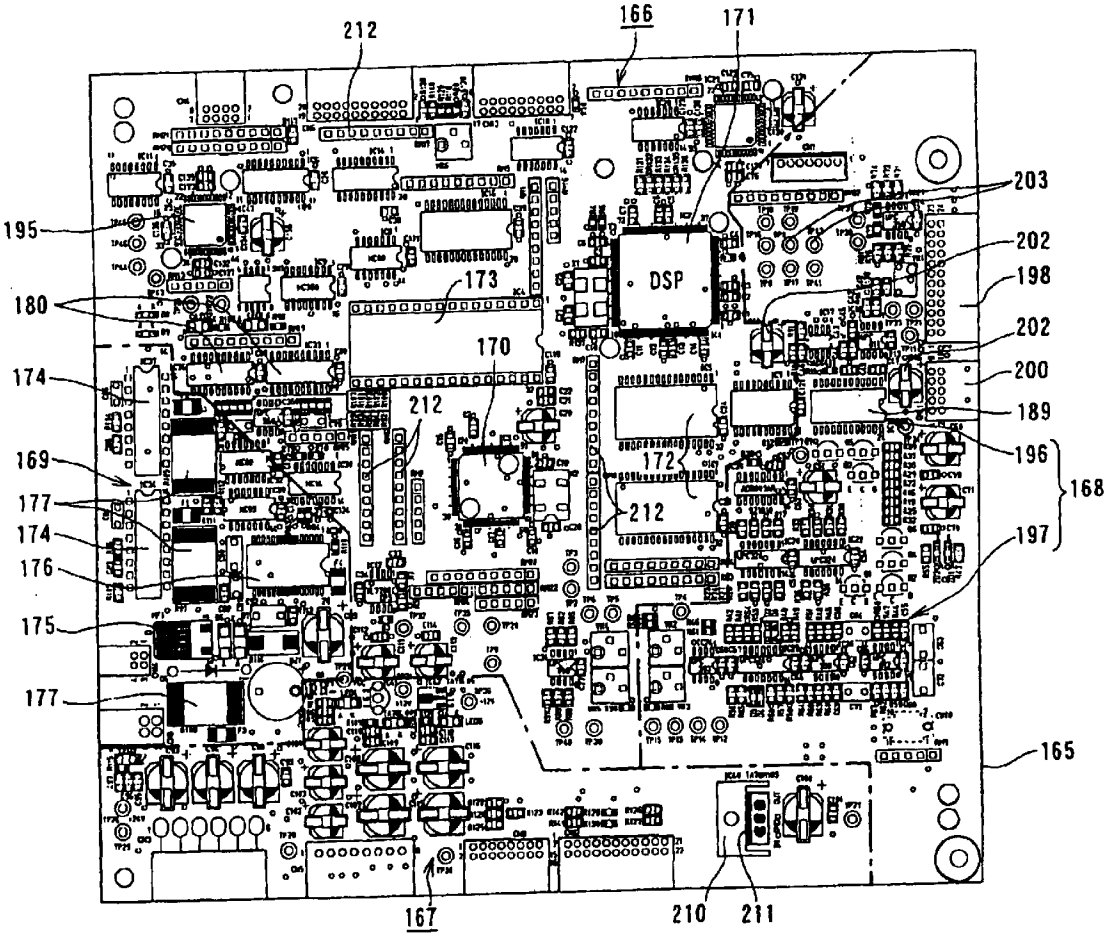
FIG. 22 shows a circuit board accommodated in a side space of the currency note identification counter of FIG. 1.

Thus, the detection signals detected by the front-reverse identification sensor 64, the line sensor 65, the true-counterfeit identification sensor 66 are fed as shown in FIG. 22 to an arithmetic control system on the circuit board 165, for arithmetic processing. The circuit board 165 is disposed in the side space 32 on the control chamber side shown in FIG. 3.

The circuit board 165 is mounted with, as shown in FIG. 22, the arithmetic control system 166, a power source system 167 for allocation of the voltage, a sensor processing system 168 and a power control system 169.

The arithmetic control system 166 has two CPUs, i.e., a control CPU 170 and an arithmetic CPU 171 such as a digital signal processor (DSP). The control CPU 170 causes the arithmetic CPU 171 to burden the arithmetic processing, to thereby achieve a prompt control of the drive motor 39 of the sheet delivery drive system 35, the drive motor 40 of the sheet conveyance drive system 37, the switching drive solenoid, not shown, of the divergence switching gate 93, a brake for stopping the delivery drive motor 39, and the sensors. Thus, the control processing speed of the mechanism actions of the currency note identification counter 10 can be increased.

The control CPU 170 is provided with a program ROM 173 in which control programs or arithmetic programs are stored. In accordance with the control programs of the program ROM 173, the control CPU 170 is subjected to the control processing so as to achieve a action control of the motor drivers 174, the brake driver 175, the gate driver 176, etc., of the power control system 169. One of the motor drivers provides a control of activation, stop and brake of the delivery drive motor 39, and the other provides a control of activation, stop and brake of the conveyance drive motor 39.

The brake driver 175 is provided for the action control of the braking devices shown such as the mechanical brake or electromagnetic brake for urgently stopping the delivery drive motor 39, with the gate driver 176 serving to provide an action control of the switching drive solenoid of the switching gate 93. Reference numeral 177 denotes a current control resistor in the power control system 169.

Figure 23:
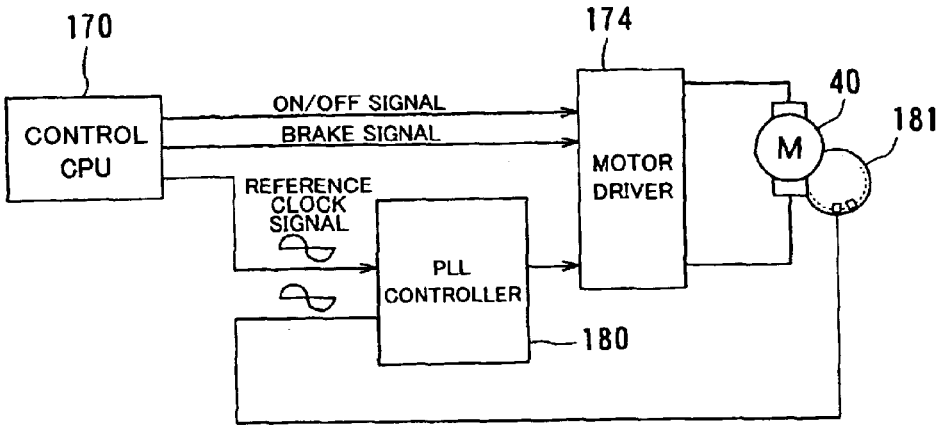
FIG. 23 shows an autonomous rotation control circuit providing a rotation control of a conveyance drive motor incorporated in the currency -note identification counter of FIG. 1.

More specifically, the control of the conveyance drive motor 40 is effected by the control CPU 170 as shown in FIG. 23. An ON/OFF signal and a brake signal from the control CPU 170 is fed to the motor driver 174 which provides an ON/OFF (drive/stop) control and braking control of the conveyance drive motor 40 that is a DC motor.

On the other hand, the motor driver 174 receives a control signal from the phase lock loop controller (PLL controller) acting as an autonomous rotation control circuit. In response to the control signal, the motor driver 174 provides a rotational speed control of the conveyance drive motor 40. For comparison and arithmetic, the PLL controller 180 receives a reference clock signal from the control CPU 170 and an encoder (rotational speed) signal from the encoder for effecting the detection of the rotational speed of the conveyance drive motor 40, and provides as its output a rotational speed control signal for driving the motor driver 174.

In this context, the conveyance drive motor 40 is subjected to a motor driver ON/OFF (drive/stop) control and a brake control in response to the control signals (ON/OFF signal, brake signal) from the control CPU 170, although the rotational speed control of the conveyance drive motor 40 is effected by the PLL controller 180. The PLL controller 180 constitutes the autonomous rotation control circuit of the conveyance drive motor 40 and provides the rotational speed control of the conveyance drive motor 40 in response to the reference pulse issued from the control CPU 170.

The PLL controller 180 constitutes means for reducing the processing burden of the control CPU 170. By virtue of the presence of the PLL controller 180, the control CPU 170 has only to feed the reference pulse signal to the PLL controller 180 which is a motor autonomous rotation control circuit so that the processing burden of the control CPU is relieved.

The control of the delivery drive motor 37 is also effected in the same manner as the control of the conveyance drive motor 40, with the provision of the autonomous rotation control circuit such as the PLL controller 180.

The motor rotational speed control of the delivery drive motor 37 and the conveyance drive motor 40 is made by the PLL controller 180, not by the control CPU 170. In a case where the control CPU provides the motor rotational speed control, the control CPU 170 monitors and controls the motor rotational speed, with the result that the processing of interruption into the control CPU 170 is increased, which may possibly reduce the processing time for the other control system processing of the control CPU 170. Due to the provision of the PLL controller 180 which constitutes the motor autonomous rotation control circuit, the motor rotational speed control is effected by the PLL controller 180 side so that the processing burden of the control CPU 170 is relieved.

In order to further relieve the processing burden of the control CPU 170, the arithmetic control system 166 shown in FIG. 22 is mounted with an arithmetically processing CPU 171. The arithmetic CPU 171 serves to subject the detection signals (scanning data) from the various sensors to the arithmetic processing. The arithmetic CPU 171 is provided with an arithmetic DSP so as to speedup the processing time taken for discriminating the kind of currency notes.

If the currency notes of a specific one country are merely identified, then it will be sufficient to provide a CPU having a throughput conforming to its processing speed. However, this currency note identification counter 10 is characterized in that it is able to identify the currency notes of various countries. In order to identify the currency notes of the various countries, the currency note identification counter 10 will not need any modification of the counter body 11, but merely replace the identification programs for each country currency notes with another, for the identification of the currency notes of each country. The identification programs for country currency notes are stored in e.g., in a major country currency notes identification program ROM 173.

Some currency notes may cause an increase of the arithmetic (operation) amount of the identification program, which will need a provision of the fairly high-speed-processing control CPU to present a performance capable of identifying various country currency notes by a single control CPU. This is not preferable in terms of costs.

In order to impart a versatility to the dealing of the various country currency notes, the currency note identification counter 10 is provided with the arithmetic CPU 171 for high speed processing, in addition to the control CPU 170, thereby acquiring a sufficient arithmetic capabilities of the identification programs. The arithmetic CPU 171 is provided with a memory 172 and can act as an arithmetic dedicated DSP which can process the scanning data within a predetermined time and can minimize the arithmetic time for discriminating the kinds of the currency notes.

In order to identify 1200 currency notes per minute by means of the currency note identification counter 10, it is necessary to complete the discrimination of the kind of a single currency notes within 50 millisecond (msec), which will require both the high speed data processing and the accuracies in the discrimination of the kind of currency notes.

Figure 24:
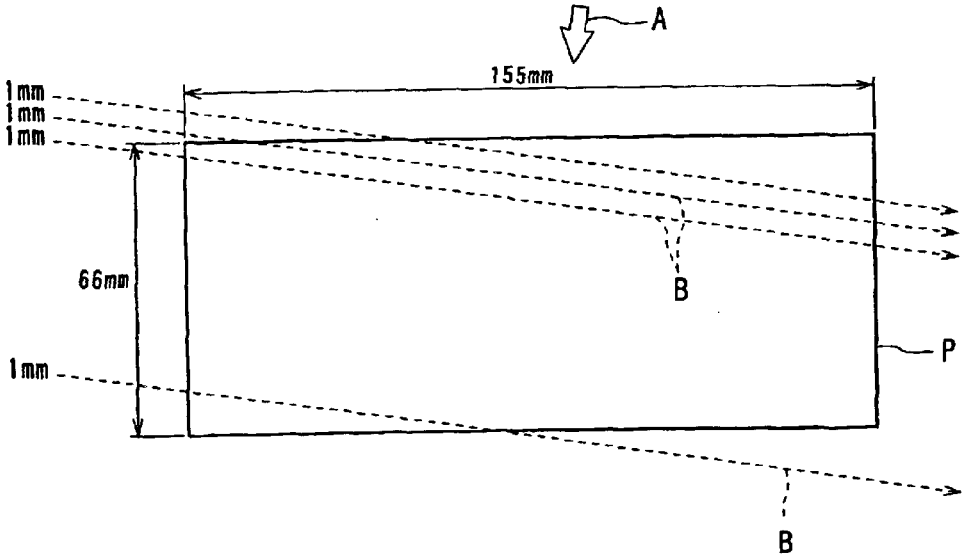
FIG. 24 shows a relationship between a timing and a line scanning effected by a line sensor constituting an identification unit of the currency note identification counter.

This currency note identification counter 10 uses the line sensor 65 as the paper identification unit 63 for the judgment of the kind of the currency notes. The line sensor 65 is a light transmission type detector consisting of, e.g., 38 light emission elements 153 and light reception elements 157 that are arrayed in line with 5 mm pitches as shown in FIGS. 17 to 20. This line sensor 65 is used to effect a serial line scanning of each detector. By iterating this line scanning, e.g., 1 mm pitch line scanning in the currency notes conveyance direction as shown in FIG. 24, the overall surfaces of the currency notes can be scanned. The reasons of the use of the light transmission type line sensor 65 is that its optical reaction speed is high as compared with the light reflection type detector needing the reading of the both surfaces of the currency notes.

More specifically, the line sensor 65 is e.g., a 38 channel (ch) detector for effecting the line scanning of the currency notes P conveyed as indicated by the broken line arrow B in FIG. 24. When the line scanning is effected in the longitudinal direction of the currency notes, with the 1 mm pitch scanning in the currency notes shorter-side direction (currency notes feeding direction), 38 detectors of the line sensor 65 can acquire 38 detection signals as the scanning data signals for each line scanning.

In a case of treating the U.S. dollar bills, its currency notes dimensions in the feed (width) direction is 66 mm, and hence, the number of samples as the scanning data corresponds to 38× currency notes feed length which results in 2508 scanning samples. The processing of these scanning data samples within a predetermined time for discrimination of the kind of the currency notes will need the arithmetic CPU 171 such as DSP for the high speed arithmetic processing. The provision of the arithmetic CPU 171 will minimize the arithmetic processing time of the currency notes P.

Figure 25:
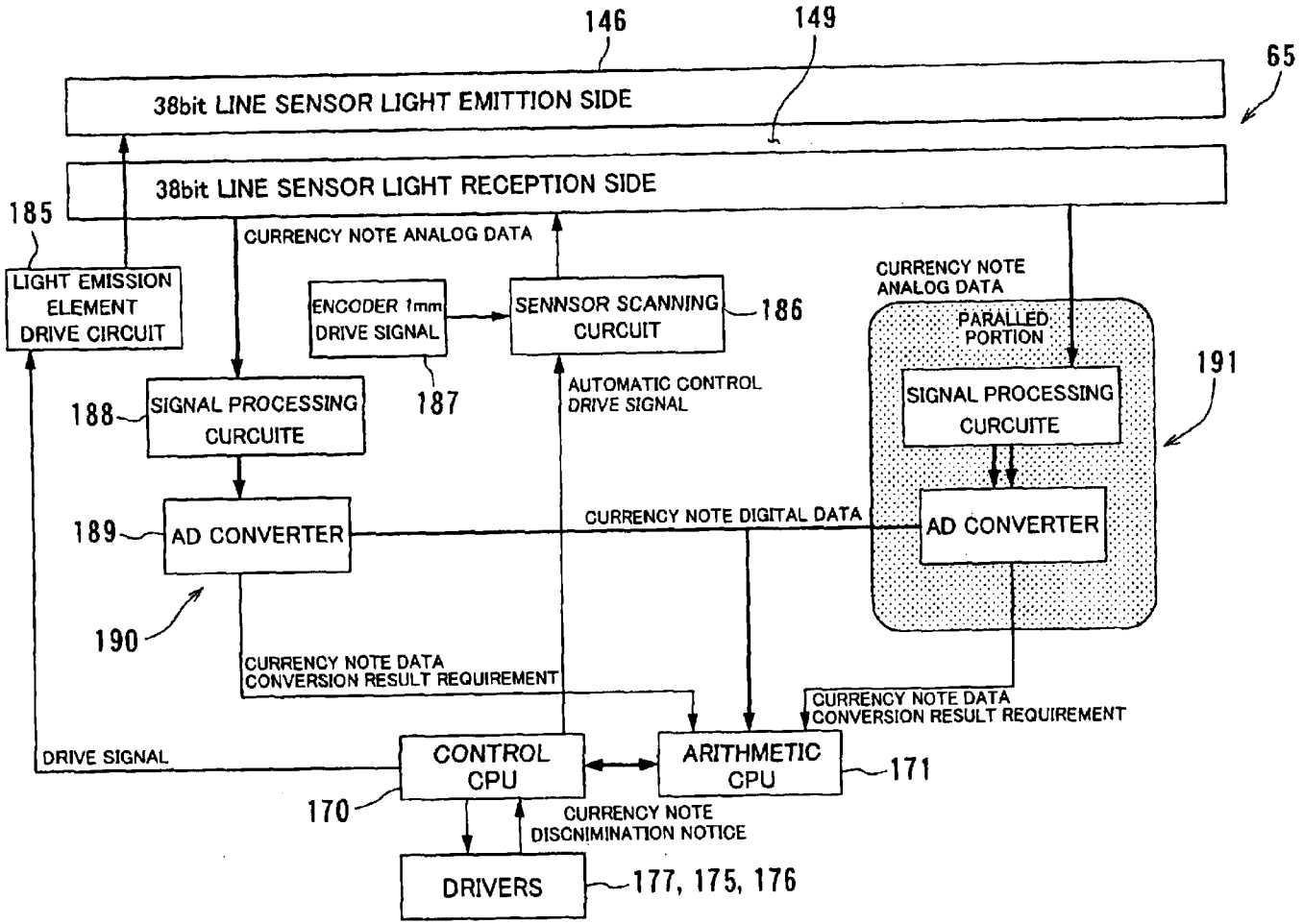
FIG. 25 is a function block diagram of serial scanning of the line sensor.

FIG. 25 is a function block diagram of the scanning processing circuit for effecting the kind of the currency notes by use of the light transmission type line sensor 65.

The line sensor 65 is activated in response to a control signal from the control CPU 170. On the light emission side of the line sensor 65, the light emission element driver circuit 185 such as the LED drive circuit is driven by the drive signal from the control CPU 170 so that the light emission elements 153 (see FIGS. 17 to 20) of the light emission side sensor member 146 are operated for light emission.

On the other hand, on the light reception side of the line sensor 65 on the other hand, the sensor scanning circuit 186 is driven by a drive signal from the control CPU 170. The sensor scanning circuit 186 receives the drive signal from the encoder 187 and issues a sensor scanning start signal.

Figure 26:
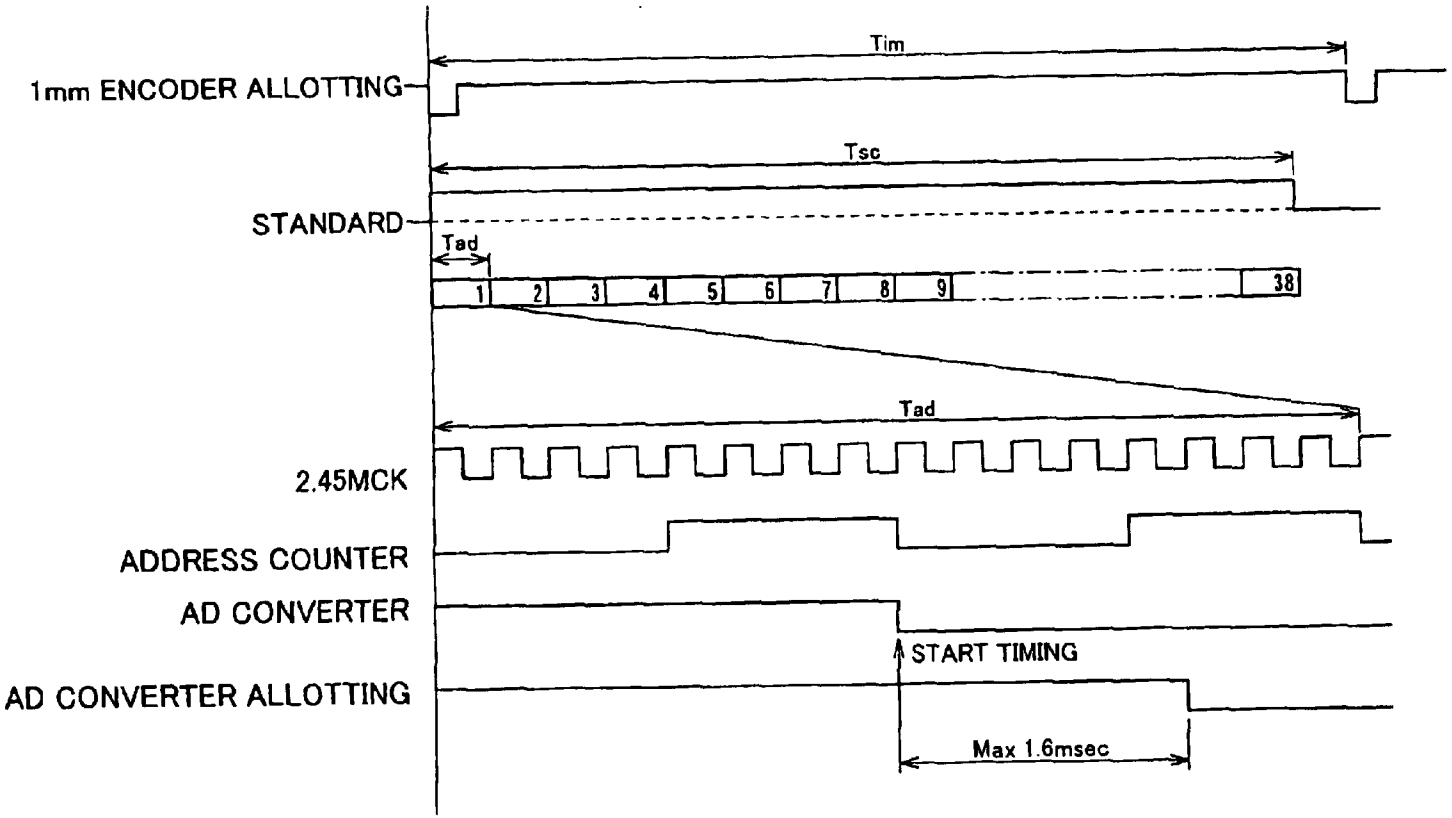
FIG. 26 shows a timing chart for the serial scanning of the line sensor.

At that time, the signal timing of the scanning processing circuit 190 has a relationship (timing chart) shown in FIG. 26.

When the sensor scanning circuit 186 of FIG. 25 receives e.g., a 1 mm drive signal (drive signal per 1 mm) from the encoder 187, the internal counter of the sensor scanning circuit 186 starts its action and the sensor scanning circuit 186 issues a scan start signal to the 38 bit line sensor 65, to initiate the line scanning operation. The encoder 187 is e.g., an encoder (i.e. 1 mm encoder) allowing an output of a drive signal per 1 mm so that, during the rotation of the delivery drive motor 53, the line scanning is effected at 1 mm cycle T1m. That is, the currency notes can be line scanned at 1 mm pitch since the 1 mm of the encoder 187 corresponds to the currency notes feed of 1 mm.

The 1 mm pitch cycle T1m of the delivery drive motor 53 results in 318 μsec in terms of the conveyance speed of 1200 currency notes per minute. During the Tsc time (Tsc<Tim) where the scan start signal is issued, 38 bit line sensor 65 is line scanned.

At that time, the scan addresses are given for each bit of the line sensor 65. The sensor scanning circuit 186 uses as the reference clock signal a 2.45 master clock signal (MCK), for example. Thus, the expansion of the one bit of the line sensor 65 results in a processing time of fixed value generated from the frequency division of 2.45 MCK. The one bit access time Tad is e.g., 6.56 μsec. The total scanning time Tsc for 38 bits results in 249.28 μs from this access time Tad. The total scanning time Tsc is a certain value irrespective of the conveyance speed.

The AD converter 189 interrupts the arithmetic CPU 171 on a bit-by-bit basis. The interruption timing allows the start of the conversion of the AD converter 189 at 50% of the access time Tad for each bit. Since the interruption time of the AD converter 189 occurs within e.g., 1.6 μsec, the start timing of the AD converter is issued at the time axis having the switching margin, for the AD conversion. After the completion of the 38 bit actions of the line sensor, the counter is self-stopped, after which 38 bit actions again start with the interruption (drive signal) of the encoder 187.

When the line scanning of the line sensor 65 is viewed from the arithmetic CPU 171, the scanning data from the line sensor are fetched by only the drive signal from the (1 mm) encoder 187, so that one line scanning corresponding to 1 mm is complete at the time when 38 bit scanning data have been fetched. After the completion of the one line scanning by the line sensor 65, the next line scanning is prepared.

Thus, the line sensor 65 allows a line scanning of the light reception elements 156 of the line sensor 65 on a line-to-line basis. The sequential iteration of this line scanning achieves the scanning of the overall surfaces of the currency notes. At that time, the encoder 187 is provided on the delivery roller (drum) 53 so as to issue a 1 mm drive signal in response to the rotation of the delivery roller 53. The delivery roller 53 is e.g., a 50 mm diameter delivery roller 53. The encoder 187 fixed coaxially with the delivery roller 53 serves to detect e.g., 1 mm feed of the delivery roller 53 and allows the sensor scanning circuit 186 to issue a drive signal for the line scanning of the light reception elements 157 of the light reception side sensor member 147 in response to the 1 mm drive signal from the encoder 187. The encoder 187 need not necessarily issue the 1 mm drive signal and may issue a drive signal of the order of several millimeters. In this case, the overall surfaces of the currency notes can be scanned at pitches of several millimeters.

A currency notes analog data signal from each light reception element 157 is fed to a signal processing circuit 188 for data processing, in which it is amplified, the currency notes analog data signal being detected by the line scanning each light reception element 157 of the light reception member 147. The signal processing circuit 188 is provided with an amplifier unit and has two processing circuits consisting of a concentration system and an automatic regulation system, which has a system circuit switching selectively switched by the arithmetic CPU 171.

The currency notes analog data signal processed by the signal processing circuit 188 is converted by an AD converter 189 into a digital signal, which is in turn fed to the arithmetic CPU 171 for the high-speed arithmetic processing. The processing data processed by the arithmetic CPU 171 is a currency notes discrimination (denomination discrimination) notice which is sent to the control CPU 170. Upon the reception of the currency notes discrimination notice results, the control CPU 170 provides as its output e.g., a drive signal of a brake driver 175 or the gate diver 176 shown in FIG. 22.

The signal processing time required for the overall scanning of the currency notes P through the line scanning with the scanning system circuit 189 of one system by use of the 38 bit (38 ch) line sensor 65 is within about 30 milliseconds in the state of the present technology. The throughput of the currency notes per minute is theoretically about 2,000 from this signal processing time.

Although FIG. 25 shows the example using the one system scanning processing circuit 190 to effect a serial line scanning with the line sensor 65, it may be possible that the light reception side of the line sensor 65 is divided at its central portion and a parallel scanning processing circuit 191 is provided for effecting a parallel line scanning of the light reception side sensor member 147 of the line sensor 65 to thereby reduce the scanning time. In this case, the throughput of the currency notes per minute can be about 4,000.

In an arrangement in which the scanning processing circuit for scanning processing of the line sensor 65 is constituted every 1 ch, the respective detectors can effect the simultaneous parallel processing of each detector to further reduce the scanning time, which however needs the scanning processing circuit for 38 ch, resulting in too large a circuit board.

In this currency note identification counter 10, as shown in FIG. 25, the line sensor having 38 detectors is formed to be processed by the one system of the scanning processing circuit 189 to thereby reduce the substrate dimensions. The serial scanning of the 19 ch detectors effected by the scanning processing circuit 189 and 190 with the provision of the parallel scanning processing circuit 190 will halve the scanning time, which will theoretically allow about 4,000 currency notes per minute of scanning.

Figure 6:
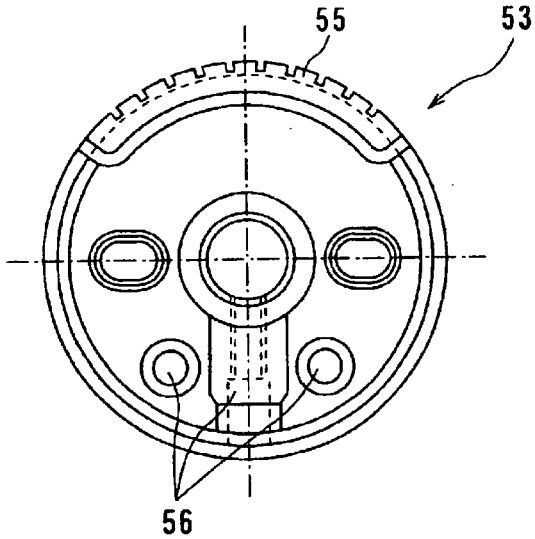
FIG. 6 shows a delivery roller disposed in a delivery mechanism of the currency note identification counter of FIG. 1.

One currency notes is delivered for each rotation as shown in FIGS. 4 and 6 from the delivery roller (drum) of the currency note identification counter 10. In order to deliver 1,200 currency notes per minute, the delivery roller 53 need to be rotationally driven at 1,200 rpm, and for 1,500/min. delivery, the delivery roller 53 will have only to be rotationally driven at 1,500 rpm.

If the US dollar bills having the currency notes feed width of 66 mm are conveyed, since the delivery roller 53 has a diameter of e.g., 50 mm, the currency notes are conveyed at about 157 mm pitch, with the interval of about 90 mm relative to the following currency notes. The 90 mm interval and the length of the conveyance passage 48 will be needed in order to ensure sufficient actions of the switching gate 93 for the currency notes having denominations which have been discriminated. The interval need not necessarily be 90 mm, but an interval exceeding the currency notes width in the feeding direction will suffice.

Actually, the occurrence of delay of the currency notes delivery or slippage will cause the narrowed currency notes conveyance intervals, which may possibly delay the currency notes identification processing. For this reason, currency note identification counter 10 has the appropriate detection sensors that are disposed downstream of the delivery roller (drum) 53, with a provision of a feed interval correcting circuit. The feed interval correcting circuit monitors the currency notes feeding interval, and if the feeding interval is small, causes the braking operation of the delivery drive system motor 39 to instantaneously reduce the motor rotational speed, or alternatively, it instantaneously activates the brake disposed on the roller axis of the delivery roller (drum) 53 to thereby delay the subsequent currency notes to modify the feeding interval to be normal. The feeding interval correcting circuit is provided on the circuit board 165 and is partially allocated to the control CPU 170.

Since the currency note identification counter 10 has the pocket 20 for discharging the currency notes out of identification, the conveyance passage 48 is diverged on the downstream side of the paper identification unit 63 into the stacker 21 side and the pocket 20 side. For this reason, the switching gate 93 is disposed on the way of the conveyance passage 48 and a solenoid, not shown, performs the switching operation of the switching gate 93.

The switching operation of the switching gate 93 can not be performed till the completion of the discrimination of the denomination after the passing of the currency notes through the paper identification unit 63. Taking into consideration the margin up to the completion of the identification of the currency notes, it is preferred that the distance from the paper identification unit 63 to the switching gate 93 be longer.

It is also desirable that the conveyance passage 48 has as a rectilinear layout or structure as possible in order to suppress the occurrence of jamming of the currency notes due to the high speed conveyance thereof along the conveyance passage 48. The rectilinear layout of the conveyance passage 48 may result in the enlargement of the apparatus and may not be suitable for the desktop use. The currency note identification counter 10 allows the conveyance passage 48 to detour within the counter body 11 so that the apparatus is made compact while allowing the rectilinear layout from the paper identification unit 63 to the branch switching gate 93. This currency note identification counter 10 achieves an overall size reduction and compactness irrespective of the throughput of the currency notes, i.e., irrespective of the fact that the 1,200 sheets per minute or more can be identified. More specifically, this desktop type cylinder head currency note identification counter 10 has front width×depth×height of 330 mm×335 mm×300 mm, respectively, by way of an example.

By the way, the currency note identification counter 10 is provided with the circuit board 165 acting as the control substrate (board) shown in FIG. 2, and the arithmetic processing system 166 of the circuit board 165 is provided with a bus emulator circuit 195 for effecting a prompt graphic processing on the display panel 17 (see FIG. 1). The display panel 17, e.g., the LCD that is a general-purpose part for the LCD graphic display is not a character display. Due to the presence of the difference in the sending or receiving timing or speed between the signal processing on the display panel 17 and the signal processing of the control CPU 170, the LCD bus emulator circuit 195 is provided as an interface circuit for adjusting and matching this difference. The LCD bus emulator circuit 195 can be integrated into one chip by use of the PLD.

The drive of the display panel 17 such as the full-graphic display LCD is effected through the processing of the control CPU 170 so that the mass of data are interchanged therebetween. However, the direct drive of the display panel 117 that is a general-purpose part by the control CPU 170, a multiplicity of processing steps are allocated to a single control CPU 170, causing the control CPU 170 to an extremely large burden.

The control CPU 170 burdens all of the control side processings of the various drivers 174, 175, 176, etc., and hence, it is preferred to reduce the burden. Furthermore, a valuable I/O port of the control CPU 170 may be used for the other controls, although this I/O port is variously restricted in use, which could not be used for the control of the operation panel 17. Furthermore, a dedicated CPU for display panel drive may additionally be provided for the purpose of achieving, a direct drive of the display panel. Otherwise, in this currency note identification counter 10, the bus emulator circuit 195 as the interface circuit between the one control CPU 170 and the general-purpose part display panel 17 may be additionally provided. This bus emulator circuit 195 looks as if it is directly driven by the control CPU 170 when viewed from the general-purpose display panel 17 side.

The addition of the bus emulator circuit 195 enables 8-bit information to be fed for processing to the display panel 17 at the same timing with a single command for example, allowing a high-speed processing. The additional provision of the bus emulator circuit 195 relieves the processings for the display panel of the control CPU 170 to a large extent so as to reduce the processing burden of the control CPU 170, allowing the high-speed processing.

In lieu of the bus emulator circuit 195, the control CPU 170 may be provided with an IO port connected to the display panel 17 so that the control CPU 170 connects the display panel 17. In the event of no difference in the sending and receiving timing or speed of the signal processing between the control CPU 170 and the display panel 17, the control CPU 170 may directly be connected to the display panel.

The sensor processing system 168 of the circuit board 165 shown in FIG. 22 is separated into a line sensor processing system 196 and a magnetic sensor processing system 197 or a UV sensor processing system. The line sensor processing system 196 is connected via a line sensor connector 198 to the line sensor 65. Reference numeral 189 denotes an AD converter for converting an operation data analog signal into a digital signal.

The magnet sensor (MG sensor) processing system 197 is connected via an MG connector 200 to the MG sensor acting as the true-counterfeit identification sensor 66. Reference numeral 201 denotes a connector for the UV sensor necessary when the UV sensor is used as the true-counterfeit identification sensor 66. Reference numeral 202 denotes a capacitor, 203 is a test point for regulation or testing, and 204 is a regulation volume for the MG sensor.

The power source system 167 is provided with a regulator 210 capable of generating a large amount of thermal energies and with a heat radiating plate 211 for radiating the heat from the regulator 210. Reference numeral 212 denotes a resistor array.

Description will then be made of the currency notes identification processing by use of the currency note identification counter 10 of the characters mentioned above.

The console panel 16 is provided on the front surface at the top of the counter body 11 of the currency note identification counter 10. The currency notes identification processing by the currency note identification counter 10 can be effected by pressing the operation buttons 18 on the console panel 16. When pressing (depressing) the operation buttons 18, the contents of currency notes identification appear on the display panel 17 such as the LCD.

The operation button 18*s* provides key switches which may include 11 (eleven) types of currency notes processings, for example. The operation buttons 18 selectively act so that any currency notes processing mode is appropriately be selectable. The currency notes processing modes implemented by the operation buttons 18 are shown in the following Table, in which description is made with reference to the case where objects of identification are the US dollar bills. The operation buttons 18 are interlinked with the key switches so that the pressing of the operation buttons 18 allows the key switches to be operated.

TABLE 1

| OPERATION BUTTONS | FORM AND USE OF OPERATION BUTTON |
|---|---|
| MODE | This operation button is pressed to perform switching of four counting modes, FREE (counting of the number of currency notes), MIXED (counting of identification of mixed denominations), SINGLE (counting of detection of different denominations), and SORT (counting of detection of denominations) and switching of SET-UP mode (that selects and sets functions pertaining to the four counting modes). The thus selected counting mode appears on a display panel (LCD). |
| ADD | Currently counted number (or amount of money) is added to most recently counted number (or amount of money) to display the result on the display panel (LCD). |
| CF | In the case of setting MG MODE or YV MODE in SET-UP mode, this operation button is depressed to add a counterfeit currency note detection function. When the counterfeit currency note detection function is added, the display panel (LCD) presents characters MG or UV. |
| DENOMI | A breakdown of the denominations identified and counted in MIXED, SINGLE, SORT modes is displayed. In the presence of instructions of gross total display with GT key, a breakdown of GT (gross total) is displayed immediately below. |
| BATCH | Each time the operation button for designating the number to be batch processed is depressed, display varies among "100" "50" "25" "10" "5" and "undesignated". The designation of the number can be varied in SET-UP mode. When varying the designation of the number one by one, "Δ" or "∇" key is pressed to vary the batch processing number. |
| GT | The gross total of the number (or amount of money) counted so far is displayed, and when depressed again, the most recently counted number (or amount of money) is displayed on. the display panel (LCD). |
| UNIT | Each time this operation button is depressed, the amount of money display or the number display is switchingly displayed. In the case of selection of the amount of money display, $ mark (or ¥ mark) is added to the forefront of the numerals for display. |
| CHECK | This operation button is used to store the most recently counted number (or amount of money) and to count in comparison with the currently counted number (or amount of money). When designation of the CHECK button is present, no addition is made to the gross total. Upon the selection of the CHECK button, CHECK appears on the display panel (LCD). |
| CLEAR | This operation button is used to cancel a conveyance error or to clear a count value for each counting operation from the gross total. It is also used to cancel items selected in SET-UP mode. |
| RESTART STOP | This is pressed to start or restart the counting operation. It is also used when setting selected items in SET-UP mode. |
| ∇ Δ | These buttons are used to increase or decrease the batch number one by one, or to select SET-UP mode items, or to select designated denomination in SINGLE mode or any denomination on DENOMI display. |

When the currency note identification counter 10 is actuated after feeding of the currency notes P to be identified into the hopper 15 with the currency note identification contents selected by use of the operation buttons 18, the delivery drive motor 39 and the conveyance drive motor 40 are activated as shown in FIGS. 2 and 3 to drive the sheet delivery drive system 35 and the sheet conveyance drive system 37 which constitute the sheet conveyance apparatus.

The drive of the sheet delivery drive system 35 causes the feed roller 50 and the delivery roller (drum) 53 to be driven in synchronism with each other as shown in FIG. 4. The feed roller 50 is arranged to feed, one by one from the bottom-most one, the sheets in the form of currency notes stacked in the hopper 15, into the conveyance passage 48. On the other hand, the delivery roller (drum) 53 is arranged to deliver the currency note 14 fed from the feed roller 50 to the rectilinear conveyance passage 48*a* of the conveyance passage 48.

One rotation of the delivery roller 53 allows a delivery of one currency note. In order to achieve rotations at e.g., 1,200 rpm or more, the feed roller 50 and the delivery roller 53 are provided with weight balancers 52 and 56 as shown in FIGS. 5 and 6 for securing a rotational balance.

Figure 27A:
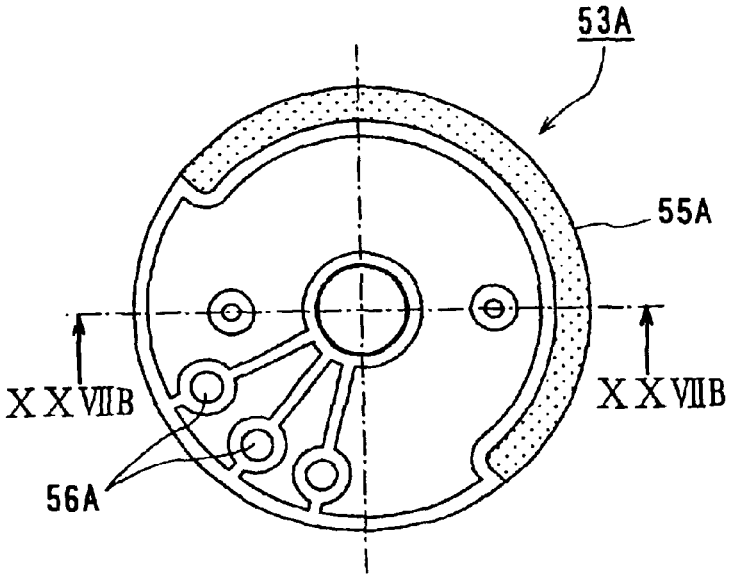
FIG. 27A shows a modification of the delivery roller provided in the delivery mechanism of the currency note identification counter.
Figure 27B:
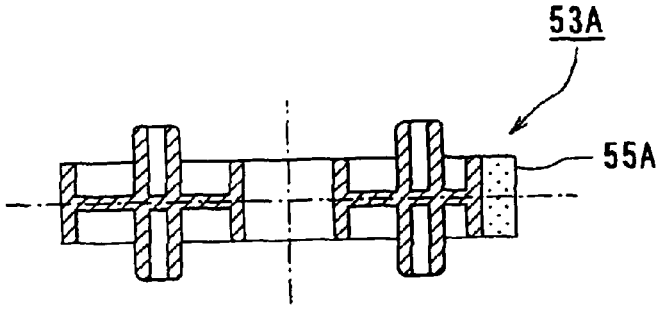
FIG. 27B is a sectional view of the modification, taken along a line XXVIIB—XXVIIB of FIG. 27A.

The delivery roller may be constructed as shown in FIGS. 27A and 27B. A delivery roller 53A has a semi-circular friction member 55A formed partially in the circumferential direction and a balancer weight 56A integrated with or integrally provided at a position diametrically confronting the friction member 55A.

The rectilinear conveyance passage 48*a* is a conveyance passage rectilinearly downwardly extending along the back side within the counter body 11 from the delivery roller 53 towards the reverse feed drive roller 70 provided below, with the currency notes 14 fed to the rectilinear conveyance passage 48*a* being subjected by the paper identification unit 63 to the currency, note denomination judgment, folded currency note judgment, normal or damaged currency note judgment and true-counterfeit currency note judgment.

The paper identification unit 63 is provided at least with the line sensor 65 and with the true-counterfeit currency note judgment sensor 66. The paper identification unit 63 may further be provided with a front-reverse identification sensor 64 for identifying the front or reverse of the currency notes.

The line sensor 65 is for example a 38-bit light transmission type detector consisting of e.g., 38 detectors that are arrayed in line with equal pitches of, e.g., 5 mm so as to traverse the rectilinear conveyance passage 48*a*. By line scanning of the line sensor 65, the currency note 14(P) is scanned, as indicated by a broken line arrow B, in the longitudinal direction as shown in FIG. 24.

The currency note P is fed at a high speed in its shorter-side direction along the conveyance passage 48, although the currency note P transported on the conveyance passage 48 is actually permitted to have a slight inclination. This permissible angle of the longitudinal direction of the conveyance passage 48 is of the order of 12 to 15°, for example.

The line sensor 65 is linearly (line) scanned along the longitudinal direction of the currency note P and then scanned in sequence at 1 mm pitch in the currency note feeding direction. Through this scanning of the line sensor 65, the overall surface is scanned of the currency note P conveyed on the rectilinear conveyance passage 48*a*.

By scanning the overall surface of the currency note P, it is possible to utilize the difference in patterns and lightness between the printed zone and the unprinted zone of the currency note P, with the setting of an appropriate threshold value, to thereby effect a discrimination (judgement) of denomination of the currency note P as well as a judgement of the normal or damaged state of the currency note P. For example, the currency note having a small difference in lightness is judged and identified as a damaged currency note, the one having a large difference in lightness is judged and identified as a normal currency note. It would be impossible for any detector which scans a part of the currency note P instead of the overall surface thereof to make a true-counterfeit judgment of the currency note.

By virtue of the detection and scanning of overall surface of the currency note P, the line sensor 65 is able to detect the corner fold of the currency note P or damaged or folded currency notes so that these currency notes P can be judged as the currency notes out of identification.

Furthermore, the true-counterfeit identification unit 66 constituting the paper identification unit 63 makes a judgment as to whether the currency note is true or counterfeit. The true-counterfeit identification unit 66 may be composed of for example a magnet sensor (MG sensor), or alternatively, it may be a combination of the magnet sensor and the UV sensor. The MG sensor and the UV sensor of the true-counterfeit identification unit 66 may be disposed in the longitudinal direction of the conveyance passage 48*a*.

After the front-reverse judgment of the currency note P, the denomination judgment, the normal-damaged judgment, the currency note fold error detection and the true-counterfeit judgment by the paper identification unit 63 arranged on the rectilinear conveyance passage 48*a*, the currency notes are guided into the U-shaped curvilinear conveyance passage 48*b* formed in the lower portion on the back side of the counter body 11. This curvilinear conveyance passage 48*b* forms a gentle curved passage having a radius of curvature of 50 mm (φ) or more to prevent the currency note jamming from occurring. The sufficient length of the curvilinear conveyance passage 48*b* will accommodate the identification processing time of the paper identification unit 63 with margin.

A light transmission type gate timing sensor 75 is disposed at the inlet end side of the angled conveyance passage 48*c* of the downstream conveyance passage following the U-shaped curvilinear conveyance passage 48*b* to thereby detect the passage or non-passage of the currency note P that has been identification processed. In response to the detection signal from the gate timing sensor 75, the control CPU 170 shown in FIG. 22 drives the gate driver 176, which in turn causes the switching gate 93 to be switchably driven in unison.

In cases where the paper identification unit 63 discriminates or judges that the currency note is a one to be identified and is a true one free from any fold or damage, the switching gate 93 is changed over to allow the currency note to be guided to the stacker 21. On the contrary, if the paper identification unit 63 identifies that the currency note is a folded or damaged one or a counterfeit one, then the gate timing sensor 75 takes the timing to switch the switching gate 93 towards the eject conveyance passage 48*d* on the pocket 20 side.

As a result of the changeover of the switching gate 93, the currency notes are guided from the angled conveyance passage 48*c* to the eject conveyance passage 48*d*, through which they are led to the pocket 20. The currency notes led to the pocket 20 can easily be ejected from the front side by opening the support member 23. The currency notes guided to the stacker 21 and stacked therein are also easily retrieved from the upwardly directed large opening of the stacker 21.

On the other hand, the contents identification processed by the currency note identification counter 10 are displayed timely on the display panel 17 such as an LCD capable of full-graphic representation so that the operator instantaneously checks the contents of the identification processing by viewing the display panel 17. The contents of the identification processing could be presented as a hard copy by use of a built-in copier not shown.

The currency note identification counter 10 is capable of performing the identification processing at a speed of 1,200 sheets per minute or at a higher speed so as to be stacked on the hopper 15. To achieve rapid and stable identification processing of the currency notes, a sufficient length of the conveyance passage 48 is secured in spite of the small-sized and compact desktop conveyance passage.

In order to secure the sufficient length of the conveyance passage 48, the conveyance passage 48 is arranged in a zigzag manner within the counter body 11 of the currency note identification counter 10. In spite of the zigzag arrangement of the conveyance passage 48, the curved portion is designed to have a sufficiently large radius of curvature so that the large radius of curvature of the conveyance passage 48 can prevent the currency notes from jamming on the way of the conveyance passage 48.

In the case of performing the identification processing of 1,200 sheets or more by the currency note identification counter 10, the feeding speed of the currency notes conveyed along the conveyance passage 48 will reach as high a speed as 3.14 m/sec and jamming may occur on the way of the conveyance passage 48. The currency note jamming is detected by the various sensors provided along the conveyance passage 48, with the result that the brake driver 175 is urgently driven by way of the control CPU shown in FIG. 22, bringing the motor rotation of the delivery drive motor 39 shown in FIG. 2 to an urgent stop. The urgent stop of the drive motor 39 causes a stop of the driving of the sheet delivery drive system 35, putting the roller rotations of the delivery roller (drum) 53 (see FIG. 4) into an urgent stop.

When jamming occurs on the midway of the conveyance passage 48, the motor drive of the conveyance drive motor 40 (see FIG. 3) is also brought to a stop. This stop of the motor drive is caused slightly after the urgent stop of the delivery drive motor 39. The stop of the driving of the sheet conveyance drive system 37 makes it impossible to guide the currency notes lying on the midway of the conveyance passage 48 to the stacker 21 or to the pocket 20, allowing the currency notes to remain on the midway of the conveyance passage 48. However, in this event, the provision of the conveyance passage opening mechanisms 112, 125 and 130 permits the conveyance passages 48*a*, 48*b*, 48*c* and 48*d* to be opened to a large extent so that the jammed currency notes can easily be retrieved and removed from the conveyance passage 48.

Figure 9:
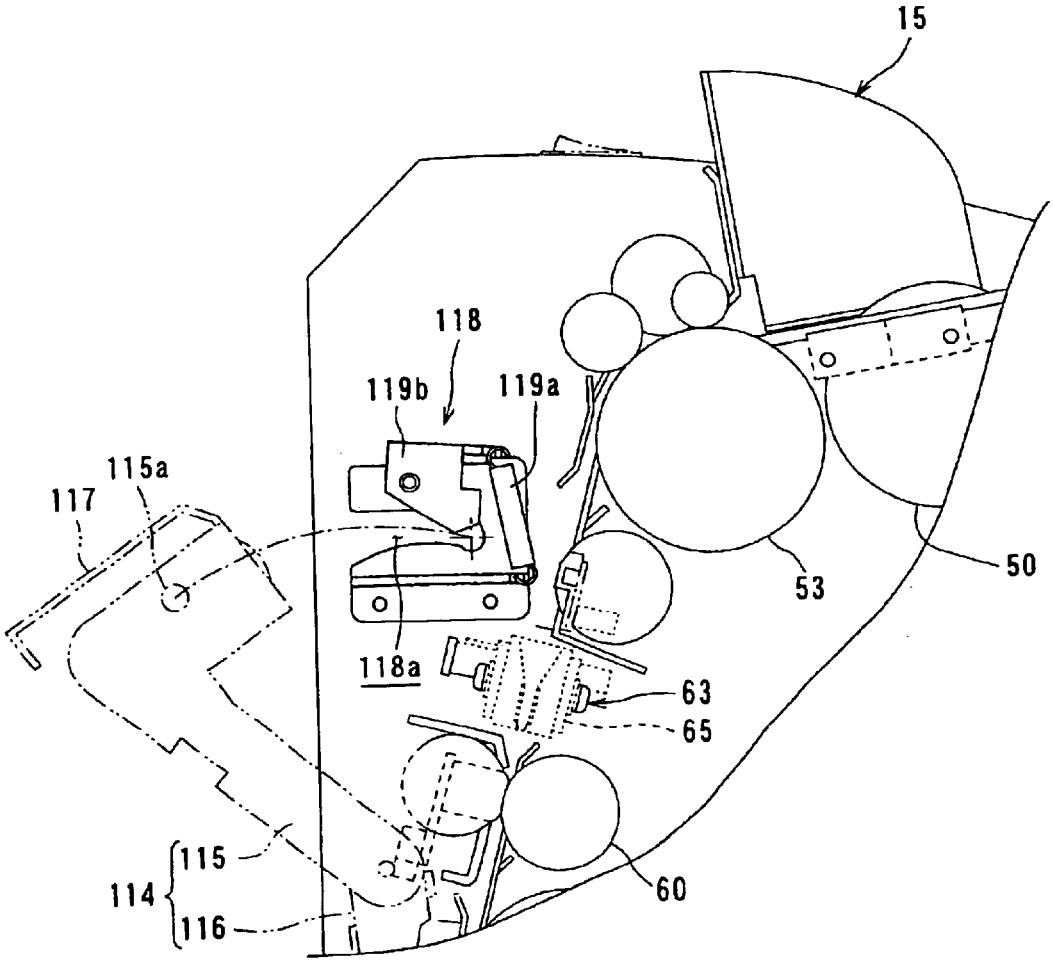
FIG. 9 illustrates the back side conveyance passage opening mechanism being unlocked (opened), provided in the currency note identification counter.

In the event that the jammed currency notes are resident in the rectilinear conveyance passage 48*a* or in the U-shaped curvilinear conveyance passage 48*b*, the rear door 120 is opened as shown in FIGS. 7 to 9 to open the back side conveyance passage opening mechanism 112. The opening of the back side conveyance passage opening mechanism 112 allows the rear opening guide arm mechanism 114 to rotate around the pivot 113 while simultaneously allowing the upper guide arm 115 to rotate around the pivot of the lower guide arm 116, so that the rectilinear conveyance passage 48*a* and the U-shaped curvilinear conveyance passage 48*b* that are formed on the back side of the counter body 11 can open to a large extent toward the back side. The opening of the rectilinear conveyance passage 48*a* and the U-shaped curvilinear conveyance passage 48*b* allows an easy retrieval of the currency notes jammed in those portions or of the currency notes remaining therein, for the removal from the conveyance passages 48*a* and 48*b*.

After the removal of the jamming currency notes from the conveyance passages 48*a* and 48*b*, the hand-lever is gripped and the wrist pin of the rear opening guide arm mechanism 114 is pushed into the lock means 118 as shown in FIG. 8, for engagement and locking by which the conveyance passages 48*a* and 48*b* can be closed so that the back side conveyance passage opening mechanism 112 can be held in its set state. By putting the back side conveyance passage opening mechanism 112 into its set state, on the back side of the counter body 11 are formed the rectilinear conveyance passage 48*a* extending from the delivery roller 53 up to the reverse feed drive roller 70 and the U-shaped curvilinear conveyance passage 48*b* formed in the region of the reverse feed drive roller 70.

In the case of the occurrence of the currency note jamming in the angled conveyance passage 48*c* of the currency note identification counter 10, the angled conveyance passage opening mechanism 125 is opened from the front side of the counter body 11 as shown in FIG. 10. By depressing the hand-lever 128 against the urging force of the paired springs 129, the opening guide arm mechanism 126 of the angled conveyance passage opening mechanism 125 rotates around the pivot 113 so that the angled conveyance passage 48*c* can open forward to a large extent.

This enables the currency notes residing in the angled conveyance passage 48*c* to easily be retrieved forward of the counter body 11 through the space defined between the paired stacker impellers 90.

Furthermore, in the case of the currency note jamming occurring in the reject conveyance passage 48*d* of the currency note identification counter 10, the reject conveyance passage opening mechanism 130 is operatively opened as shown in FIG. 11. To open the reject conveyance passage opening mechanism 130, the operation button 138 depicted in FIG. 1 is pressed to actuate the engagement hook 136 via the cam mechanism 140 as shown in FIGS. 12 and 13, with the result that the bridge pin 135 of the reject conveyance passage opening mechanism 130 is released from the engagement hook 136.

Once the bridge pin 135 of the reject conveyance passage opening mechanism 130 is released, the opening guide arm mechanism 132 can rotate by its own weight around the pivot 131 over a large angular range. At that time, it is desirable for the support member 23 to be freely set from the pocket bearer 22.

Then, the large angular rotation of the opening guide arm mechanism 132 around the pivot causes the pocket bearer 22 to rotate counterclockwise in FIG. 11, allowing the counter body 11 to be opened forward to a large extent. As a result of the front opening of the counter body 11, the reject conveyance passage 48*d* opens to a large extent forward of the counter body 11 so that the currency notes residing in the reject conveyance passage 48*d* can be removed through the opening thereof.

Although in one embodiment of the paper identification counter, description has been made by way of an example of the identification processing of 1,200 sheets per minute in the form of currency notes, the currency note identification processing could be carried out at a high speed of 1,500 notes per minute or at a higher speed. In the event of performing the high speed processing of 1,500 notes per minute, the delivery roller (drum) needs to be rotationally driven at 1,500 rpm so that this rotational drive of the delivery roller can be interlinked with the identification processing time of the identification unit. It would also be possible to process the currency notes at a low speed of the order of 700 to 800 sheets per minute.

Although in one embodiment of the paper identification counter, description has been made by way of the example of identifying and counting the currency notes, the identification and counting may be effected of various papers other than the currency notes, such as government or corporate bonds or other securities; tickets or coupons for railroads, airlines, buses, etc.; certificates for gifts, books, stationery or other notes. In such cases, identification patterns of papers to be measured must previously be programmed in, e.g., a program ROM of the arithmetic control system on the circuit board.

Although in the paper identification counter of one embodiment, the power source has been positioned for example at the bottom on the back side of the counter body, with the reverse feed drive roller disposed above the power supply, the power source may be displaced in any dead space within the counter body so that the reverse feed drive roller can be positioned in the vicinity of the bottom on the back side of the counter body. In this case, the conveyance passage can have a greater length, achieving a further speedup. This also enables the roller diameter of the reverse feed drive roller to be increased, with a further increase of the radius of curvature of the U-shaped curved conveyance passage.

Although in the paper identification counter of one embodiment, the stacker has been placed, for example, on the front of the counter body at the lower portion thereof, with the pocket disposed above the stacker, the stacker may be provided above the pocket so that the conveyance passage extending from the reverse feed drive roller up to the stacker can be rendered rectilinear in order to provide a more effective prevention of the paper jamming.

It is to be noted that the present invention is not limited to the described embodiments and many other changes and modifications may be made without departing from the scopes of the appended claims.

What is claimed is:

1. A paper identification counter comprising:

a counter body;

a hopper disposed at a top portion of the counter body;

a stacker disposed at a front portion of the counter body;

a conveyance passage formed in the counter body so as to extend from the hopper to the stacker;

a feed mechanism for feeding papers stacked on a bottom of the conveyance passage; and a delivery mechanism for delivering the papers from the feed mechanism to the conveyance passage;

said feed mechanism and said delivery mechanism having a feed roller and a delivery roller, respectively, which are rotationally driven in synchronism with each other, said feed roller and said delivery roller each being formed, at a portion in a circumferential direction thereof, a friction member for providing a paper feed frictional force, said feed roller and said delivery roller being each provided with a balancer weight at a location diametrically opposing said friction member.

2. A paper identification counter according to claim 1, wherein said delivery mechanism includes a stop member coming into press contact with the delivery roller, the stop member preventing papers from being fed in an overlapped manner.

3. A paper identification counter according to claim 1, further comprising a pocket disposed above the stacker and adapted to store therein papers rejected from the conveyance passage, said pocket including a pocket bearer and a support member covering the pocket bearer from a front side thereof.

4. A paper identification counter according to claim 3, wherein said pocket includes a pocket bearer disposed at a free end of a guide arm of a reject conveyance passage opening mechanism, a forward extending pocket arm securely fastened to the counter body and a support member interposed between the free end of said pocket arm and the fore-end of said pocket bearer, said support member being supported by one of the free end of the pocket arm and the fore-end of the pocket bearer and being releasably fixed to another one thereof.

5. A paper identification counter according to claim 3, wherein said pocket is opened at both sides thereof, a front side portion of the pocket being covered with a pair of side members which are supported by one of said free end of the pocket arm and said fore-end of the pocket bearer, said pair of side members being releasably fixed to another one thereof by a one-touch fastener.

6. A paper identification counter according to claim 5, wherein said one-touch fastener includes a magnet.

7. A paper identification counter according to claim 3, wherein said support member is provided with a shock absorbing resilient member adhering an inside portion of the pocket and said support bearer is notched centrally at the front portion thereof so as to form a retrieval opening.

8. A paper identification counter according to claim 7, wherein said resilient member includes a sponge.

9. A paper identification counter according to claim 3, wherein said conveyance passage includes a rectilinear conveyance passage descending from the hopper through the delivery mechanism along the back side of the counter body, said rectilinear conveyance passage including a paper identification unit provided with a line sensor, said line sensor being a light transmission type detector including a plurality of light emission elements which are arrayed in the width direction of the conveyance passage and including a plurality of light reception elements which confront the light emission elements in a one-to-one corresponding manner, and said paper identification counter including a scanning processing circuit arranged to serially scan in line a train of said light reception elements of said line sensor, and an arithmetic CPU arranged to process serial scanning data from the scanning processing circuits.

10. A paper identification counter according to claim 9, wherein said scanning processing circuit includes a sensor scanning circuit for serially scanning the train of the light reception elements of the line sensor in response to a drive signal from the control CPU and to an encoder drive signal from an encoder detecting the rotational speed of the delivery roller of the delivery mechanism, a signal processing circuit for processing test data signals as a result of serial scanning of the train of the light reception elements, and an AD converter for converting an analog signal to a digital signal so as to input a test data digital signal from said AD converter to said arithmetic CPU.

11. A paper identification counter according to claim 9, wherein said control CPU and said arithmetic CPU are mounted on a circuit board accommodated in a side space inside the counter body, said control CPU performing a control of a delivery drive motor, a conveyance drive motor, a brake for stopping said delivery drive motor and various sensors, said arithmetic CPU being an arithmetic only processor processing a scanning data from the line sensor.

12. A paper identification counter according to claim 9, wherein said control CPU issues start/stop and brake signals for a delivery drive motor and a conveyance drive motor to a motor driver, said control CPU providing a rotation control of the drive motors by way of an autonomous rotation control circuit which receives a reference clock signal from the control CPU and a signal from an encoder detecting the rotational speed of the delivery drive motor and the conveyance drive motor.

13. A paper identification counter according to claim 9, wherein said control CPU includes a bus emulator circuit intervening between said control CPU and a display panel such as an LCD, said bus emulator circuit achieving matching with an interface of said display panel to partially share processing to be effected by the control CPU.

* * * * *